US005630708A

United States Patent [19]

Kushida et al.

[11] Patent Number: 5,630,708

[45] Date of Patent: May 20, 1997

[54] RADIAL PISTON PUMP FOR LOW-VISCOSITY FUEL

[75] Inventors: Takeo Kushida; Fujio Aoki; Takayuki Ikeda; Koichiro Futamase; Tomoharu Sato; Hideya Kikuchi; Ken Sato; Nobuo Aoki; Katsuhiko Tsukazaki, all of Higashi-Matsuyama, Japan

[73] Assignee: Zexel Corporation, Japan

[21] Appl. No.: 364,857

[22] Filed: Dec. 27, 1994

[30] Foreign Application Priority Data

Dec. 28, 1993 [JP] Japan ..... 5-348915
Jul. 12, 1994 [JP] Japan ..... 6-181989

[51] Int. Cl.[6] ..... F04B 1/053

[52] U.S. Cl. ..... 417/273; 417/420; 91/491

[58] Field of Search ..... 417/273, 420; 91/491

[56] References Cited

U.S. PATENT DOCUMENTS 4,610,606 9/1986 Hazzard et al. ..... 417/273
5,213,482 5/1993 Reinartz et al. ..... 417/273

FOREIGN PATENT DOCUMENTS 2426801 1/1980 France ..... 91/491
60-216081 10/1985 Japan .
64367 1/1989 Japan .
3175158 7/1991 Japan .
486377 3/1992 Japan .
4103265 9/1992 Japan .
5256252 10/1993 Japan .

*Primary Examiner*—Timothy Thorpe
*Assistant Examiner*—William Wicker
*Attorney, Agent, or Firm*—Ostrolenk, Faber, Gerb & Soffen, LLP

[57] ABSTRACT

A radial piston pump for low-viscosity fuel according to a first aspect of the invention comprises a pump housing, which is constituted of as few as two structural bodies (from among a drive-side housing member 2A, a fixed cylinder 81 and a cover 4), and a leaf valve member 82 which is formed with intake valves 87 for opening and closing intake side passages 27 and discharge valves 88 for opening and closing discharge side passages 28 and is sandwiched between two structural bodies (fixed cylinder 81 and cover 4). The first aspect of the invention reduces the number of components constituting the pump housing, enables highly precise overall axial alignment, prevents wobbling of a pump shaft 9 of the pump, increases performance and reliability and reduces cost. A radial piston pump for low-viscosity fuel according to a second aspect of the invention comprises a leaf valve member 205 formed in one and the same plane thereof with overflow ports communicating with an overflow passage 59 in the pump housing, intake valves 87 communicating with intake side passages 27 and discharge valves 88 communicating with discharge side passages 28. The third aspect of the invention provides a method for assembling the radial piston pump for low-viscosity fuel according to the second aspect of the invention.

20 Claims, 17 Drawing Sheets

RADIAL PISTON PUMP FOR LOW-VISCOSITY FUEL

BACKGROUND OF THE INVENTION

1. Field of the Invention

This invention relates to a radial piston pump for low-viscosity fuel and a method for assembling the pump, more particularly to a radial piston pump for low-viscosity fuel which is ideal for high-pressure delivery of low-viscosity fuel and which, owing to an improvement in its fuel paths, features high reliability and compact size, and to method for assembling the pump.

2. Prior Art

Improvement of the combustion efficiency of the internal combustion engines used in vehicles and the like is widely accepted as necessary for reducing the pollution caused by exhaust gases, as well as for preserving natural resources. An effective way of improving combustion efficiency in a gasoline engine is to promote fine atomization of the fuel spray by delivering the gasoline under high pressure. Fine atomization is also required in the case of alcohols and other such alternative fuels (referred to simply as "alcohols" in this specification) now being considered for use in internal combustion engines, since alcohols have poor cold starting characteristics.

Since the delivery pressure of 3–4 Kgf/cm$^2$ of ordinary fuel pumps is insufficient for achieving the required degree of atomization, there is a need for a high-performance pump capable of producing a delivery pressure of several tens of Kgf/cm$^2$.

As a type of pump suitable for this purpose, the radial piston pump is a strong candidate from the aspects of performance and efficiency. The radial piston pump is described, for example, in Japanese Patent Disclosure No. Sho 60-216081.

The prior art radial piston pumps, such as that taught by Japanese Patent Disclosure No. Sho 64-367, have generally been used as hydraulic pumps, namely as means for delivering pressurized high-viscosity oil (viscosity ≧30 cst). No problems arise regarding the performance of the prior art radial pumps so long as they are used with high-viscosity oil. The viscosity of alcohols is, however, on the order of 0.5 cst, which is extremely low.

An attempt to adapt a conventional radial piston pump for high-pressure delivery of a fuel having such low viscosity property simply by modifying the cylinder block from the rotary type to the stationary type or to the stationary cylinder type in which only the pistons reciprocate is doomed fail because the pump will not be able to maintain its performance. This because such a modification does not overcome such problems as, for example, dissolving and dilution of the grease sealed in the drive shaft bearing by the low-viscosity fuel and galling and seizing occurring between the pistons and the barrels or between the eccentric cam and the ends of the pistons.

The prior art radial piston pump is thus incapable of smoothly and stably delivering low-viscosity fuel under high pressure.

For overcoming these problems, the assignee previously developed a practical radial piston pump capable of stably pumping low-viscosity fuels such as gasoline and alcohols even at high pressures exceeding several tens of Kgf/cm$^2$, without damage to the bearing portions or occurrence of galling and seizing at the piston sliding surfaces.

This pump is described in detail in Japanese Patent Disclosure No. Hei 3-175158 and will be explained with reference to FIGS. 1 to 4, in which it is designated by reference numeral 1.

The radial piston pump for low-viscosity fuel 1 is shown in an overall sectional view in FIG. 1, in an exploded perspective view in FIG. 2, and in a sectional view along line III—III of FIG. 1 in FIG. 3. The radial piston pump for low-viscosity fuel 1 has a housing member 2 (first pump housing member), a fixed cylinder 3 (second pump housing member), a cover 4 (third pump housing member), an intake side gasket 5, an intake se leaf valve member 6, a discharge side gasket 7, a discharge side leaf valve member 8 and a pump shaft 9. The housing member 2, fixed cylinder 3, cover 4, intake side gasket 5, intake side leaf valve member 6, discharge side gasket 7 and discharge side leaf valve member 8 are held in position by positioning pins 10 and fixed together by stud bolts 11.

The pump shaft 9 is inserted into a hole at the center of the joined members to be rotatably supported by a radial bearing 12 provided on the housing member 2, a thrust bearing 13 provided on the cover 4 and a radial bearing 14 provided on the cover 4, and is rotated through a drive pulley 15 by an external engine (not shown). The portion of the pump shaft 9 positioned within the pump shaft 9 is formed with an eccentric cam 16.

A first oil seal 17 and a second oil seal 18 provided in the housing member 2 on opposite sides of the radial bearing 12 prevent the low-viscosity fuel, which is a solvent, from diluting the grease sealed in the radial bearing 12. A fuel intake port member 19 is mounted on the housing member 2 and the interior portion in communication with the intake port member 19 is formed with intake passages 20 and radially formed annular chamber inlets 21, and with a center cavity 22. The number of intake passages 20 and annular chamber inlets 21 is the same as the number of cylinder holes 23 and cap-shaped pistons 24 (both explained below) provided in the fixed cylinder 3 (five in the example illustrated in FIG.3).

The annular chamber inlets 21 are inlet passages for feeding low-viscosity fuel into an annular chamber 33 (explained later) and supplying it to the cylinder holes 23, and are used for lubrication.

The cylinder holes 23 (five in the illustrated example) are formed to extend radially through the fixed cylinder 3 at regular intervals. A cap-shaped piston 24 is accommodated in each fixed cylinder 3 to be free to reciprocate therein. In each fixed cylinder 3, the piston 24 is pressed radially inward by a piston spring 26 inserted between itself and a plug 25 screwed into the cylinder holes 23. As the pistons 24 slidingly contact the eccentric cam 16 of the pump shaft 9 at their head portions, they reciprocate as the pump shaft 9 rotates. This reciprocation produces a pumping action for intake and delivery of the low-viscosity fuel.

The position of contact between the pistons 24 and the eccentric cam 16 is approximately at the center of the fixed cylinder 3.

An intake side passage 27 and a discharge side passage 28 are formed in the fixed cylinder 3 on opposite sides of each cylinder hole 23 so as to communicate therewith. The intake side passage 27 and the discharge side passage 28 communicate with a pressurization chamber 29 (FIG. 3) formed between the piston 24 and the plug 25.

The intake side leaf valve member 6 is formed with intake valves 30 constituted as tongue-shaped springs (FIG. 2). The range of movement of the intake valves 30 is regulated by generally rectangular stops 31 disposed in the fixed cylinder 3 so as to selectively enable fuel intake through the intake valves 30 and the intake side passages 27 in accordance with the reciprocation of the pistons 24.

A center cavity 32 of the fixed cylinder 3 and the center cavity 22 of the housing member 2 together form the annular chamber 33 for fuel intake and lubrication.

The cover 4 has discharge passages 34 which communicate with the discharge side passages 28 of the fixed cylinder 3 and the discharge passages 34 communicate with a discharge port member 36 through a collection groove 35 (FIG. 2).

The discharge side leaf valve member 8 is formed with discharge valves 37 constituted as tongue-shaped springs (FIG. 2). The range of movement of the discharge valves 37 is regulated by generally rectangular stops 38 disposed in the cover 4 so as to selectively enable fuel discharge through the discharge side passages 28 and the discharge valves 37 in accordance with the reciprocation of the pistons 24.

The cover 4 is provided with a third oil seal 39 for preventing the grease sealed in the radial bearing 14 from being diluted by the low-viscosity fuel. Moreover, the third oil seal 39 and the second oil seal 18 close the annular chamber 33 off from the exterior at the ends of the pump shaft 9.

As shown in FIG. 4, the cover 4 is further provided with a relief valve 40 that communicates with the discharge passages 34 and the discharge port member 36. A return port 41 communicating with the annular chamber 33 is formed near the opening of the relief valve 40 for returning low-viscosity fuel to the annular chamber 33 when the pressure of the low-viscosity fuel becomes abnormally high.

As shown in FIG. 1, low-viscosity fuel is supplied to the intake port member 19 from a fuel tank 42 by a feed pump 43 and the pump action of the pistons 24 reciprocated by sliding contact with the eccentric cam 16 driven by the pump shaft 9 delivers the low-viscosity fuel to an injector (or a common rail).

To be more specific, when the pistons 24 move centripetally during the intake stroke, the intake valves 30 open and the discharge valves 37 close, so that fuel is drawn into the pressurization chambers 29 through the intake port member 19, the intake passages 20, the intake valves 30 and the intake side passages 27. On the other hand, when the pistons 24 move centrifugally during the discharge stroke, the intake valves 30 close and the discharge valves 37 open, so that fuel is discharged from the pressurization chambers 29 through the discharge side passages 28 and the discharge valves 37 to be delivered under high pressure to an injector 44 through the discharge port member 36.

The radial piston pump for low-viscosity fuel 1 described in the foregoing nevertheless has a number of drawbacks deriving from the three-body structure of the pump housing (the housing member 2, the fixed cylinder 3 and the cover 4 joined by the stud bolts 11). Specifically, the pump consists of a large number of components, is therefore difficult to assemble with highly precise overall axial alignment, is susceptible to wobbling of the pump shaft 9, is likely to develop performance and reliability problems as a radial piston pump for low-viscosity fuel, and is expensive to manufacture.

FIG. 5 is an overall sectional view of a prior-art radial piston pump for low-viscosity fuel 50 having a four-body structure. Components in FIG. 5 which are similar to those in FIGS. 1 to 4 are assigned the same reference numerals as those in FIGS. 1 to 4 and will not be explained further here.

The radial piston pump for low-viscosity fuel 50 comprises a drive-side housing member 2A and a driven-side housing member 2B which together correspond to the housing member 2, a fixed cylinder 3, a cover 4, an outer cover 51, an intake side leaf valve member 6 located between the driven-side housing member 2B and the fixed cylinder 3, a discharge side leaf valve member 8 located between the fixed cylinder 3 and the cover 4, and a nonmagnetic material partition 52 disposed between the drive-side housing member 2A and the driven-side housing member 2B.

The outer cover 51 covers the driven-side housing member 2B, the fixed cylinder 3 and the cover 4, which three components are joined by stud bolts 11.

The pump shaft 9 is divided into a drive-side pump shaft 9A and a driven-side pump shaft 9B which are located on opposite sides of the partition 52 and inked by a magnetic coupling 53 straddling the partition 52. The magnetic coupling 53 comprises a drive-side magnet 54 attached to the drive-side pump shaft 9A and a driven-side magnet 55 attached to the driven-side pump shaft 9B by a bolt 56.

The drive-side housing member 2A and the driven-side housing member 2B are joined by housing bolts 57.

The remainder of the structure for achieving pump function is substantially the same as that of the radial piston pump for low-viscosity fuel 1 of FIG. 1, except that the pistons 24 are accommodated in cylinder liners 58.

As indicated by the solid-line arrows in FIG. 5, the fuel paths are established such that fuel passes through intake passages 20, an annular chamber 33 and intake side passages 27 to the pistons 24, where it is subject to pump action, and is then discharged under pressure to an injector 44 through discharge side passages 28 and discharge passages 34.

The driven-side pump shaft 9B is provided with washers 60, 61, 62, 63 and 64 and with a first roller bearing 65, a third roller bearing 66 and a second roller bearing 67, and opposite ends of the driven-side pump shaft 9B are supported by a first bearing bush 68 and a second bearing bush 69. The washers 60–64 prevent wearing of the side surfaces of the bushes 68 and 69, the rollers 65–67 enhance wear resistance by lowering the sliding speed, and the bushes 68 and 69 increase wear resistance and reduce thermal deformation.

The pump housing of the radial piston pump for low-viscosity fuel 50 constituted in the foregoing manner thus has a four-body structure consisting of the drive-side housing member 2A, the driven-side housing member 2B, the fixed cylinder 3 and the cover 4 fixed together by the stud bolts 11 and the housing bolts 57.

It therefore has all of the various shortcomings of the radial piston pump for low-viscosity fuel 1 shown in FIG. 1. In addition, since the cylinder liners 58 and the pistons 24 are squeezed between the driven-side housing member 2B and the cover 4, the cylinder holes 23 may deform depending on the degree of tightening of the stud bolts 11.

FIG. 6 is an overall sectional view of a prior-art radial piston pump for low-viscosity fuel 70 which is of the type not having the outer cover 51. Being configured similarly to the radial piston pump for low-viscosity fuel 1 of FIG. 1., the radial piston pump for low-viscosity fuel 70 has a housing member 2, an intermediate block 2C, a fixed cylinder 3, a cover 4, an intake side leaf valve member 6 and a discharge side leaf valve member 8.

The remaining portions are substantially the same as those of the radial piston pump for low-viscosity fuel 1, except that fuel can be recirculated by overflow from a recirculation passage 59 communicating with an annular chamber 33 for intake and lubrication.

The pump housing of the radial piston pump for low-viscosity fuel 70 thus also has a four-body structure, in which the housing member 2, intermediate block 2C, fixed cylinder 3 and cover 4 are joined by stud bolts 11. It therefore involves the same problems as the radial piston pump for low-viscosity fuel 1 of FIG. 1 and the radial piston pump for low-viscosity fuel 50 of FIG. 5.

Other prior-art radial piston pumps for low-viscosity fuel are taught by Japanese Patent Disclosure No. Hei 4-86377, Japanese Utility Model Disclosure No. Hei 4-103265 and Japanese Patent Disclosure No. Hei 5-256252. Since the fuel intake and discharge ports are not in the same plane in the direction perpendicular to the axis of the pump shaft in these pumps, however, they are troublesome to hook up and assemble. In addition, since not all of the fuel sucked into these pumps is used for lubrication and cooling of the bearings and other friction points, the lubrication and cooling effect is inadequate.

They also have the disadvantage that the axial length of the pump shaft is increased when they are equipped with a cylinder type magnetic coupling.

The prior-art magnetic coupling type radial piston pump for low-viscosity fuel also have shortcomings in that a high degree of skill is required for ensuring that the various parts are assembled in the proper positional relationship and in that high-precision axial alignment is hard to achieve.

This invention was accomplished in light of the foregoing problems of the prior art and has one of its objects to provide a radial piston pump for low-viscosity fuel which achieves a reduction in the number of pump housing members irrespective of whether or not an outer cover is incorporated, enables high-precision overall axial alignment, prevents pump shaft wobble, improves performance and reliability and achieves a reduction in cost.

Another object of the invention is to provide a method for assembling a radial piston pump for low-viscosity fuel which enables reduction of overall pump size, improvement of pump performance, easier pump assembly and improvement of pump shaft axial alignment.

Another object of the invention is to provide a radial piston pump for low-viscosity fuel enabling effective lubrication and cooling of the pump shaft bearings and other friction points, and a method for assembling the same.

Another object of the invention is to provide a radial piston pump for low-viscosity fuel which is easy to hook up to external tubing, and a method for assembling the same.

SUMMARY OF THE INVENTION

A first aspect of the invention is characterized in that the intake valve member and the discharge valve member constituted as separate members in the prior art are constituted as a single leaf valve member and that the overall radial piston pump for low-viscosity fuel is constituted of as few as two structural bodies. The radial piston pump for low-viscosity fuel according to the first aspect of the invention comprises a pump housing formed with intake side fuel passages and discharge side fuel passages, a plurality of pistons disposed radially within the pump housing to be capable of reciprocation, intake valves and discharge valves for enabling intake and discharge of low-viscosity fuel by the reciprocation of the pistons, the pump housing being constituted of as few as two structural bodies, the intake valves and the discharge valves being formed in a single leaf valve member to communicate respectively with the intake side passages and the discharge side passages, and the leaf valve member being disposed between the bodies of the two-body structure.

In one preferred configuration of this radial piston pump for low-viscosity fuel, fuel paths connecting the intake valves with the pistons and fuel paths connecting the pistons with the discharge valves are formed such that the intake valves and the discharge valves can be formed on a single leaf valve member and that the fuel paths from the intake side passages to the intake valves and the pistons and the fuel paths from the pistons to the discharge valves and the discharge side passages pass each other in opposite directions without intersecting at the portion of the pump housing where the leaf valve member is disposed.

A second aspect of the invention is characterized in that the fuel intake, discharge and overflow locations are disposed within the same plane in a single leaf valve member. The radial piston pump for low-viscosity fuel according to the second aspect of the invention comprises a pump housing formed with intake side passages and discharge side passages for low-viscosity fuel, a plurality of pistons disposed within the pump housing to be capable of reciprocation, a pump shaft formed with an eccentric cam for reciprocating the pistons, and a leaf valve member formed in a single plane thereof with overflow ports communicating with the intake side passages, intake valves for opening and closing the intake side passages and discharge valves for opening and closing the discharge side passages, the reciprocation of the pistons causing intake of low-viscosity fuel through the intake side passages and discharge thereof through the discharge side passages.

In one preferred configuration of this radial piston pump for low-viscosity fuel, the overflow ports communicating with the intake side passages are further communicated with the intake valves through first communicating passages, the intake valves are communicated with the pistons through second communicating passages, and the pistons are communicated with the discharge side passages through the discharge valves.

In another preferred configuration, the intake side passages are communicated with the intake valves and also with the overflow passages, the intake valves are communicated with the pistons by third communicating passages and fourth communicating passages, and the pistons are communicated with the discharge valves by the discharge side passages.

A third aspect of the invention is characterized in that high-precision assembly of the radial piston pump for low-viscosity fuel is achieved by force fitting bushes on the pump shaft on both sides of the eccentric cam. Specifically, the third aspect of the invention provides a method for assembling a radial piston pump for low-viscosity fuel including a pump housing member formed with intake side passages and discharge side passages for low-viscosity fuel; a cover joined with the pump housing member and formed with an intake passage and a discharge passage; a flange joined to the opposite end of the pump housing member from the cover and provided with a drive-side magnet of a magnetic coupling; a plurality of pistons disposed in the pump housing to be capable of reciprocation; a pump shaft provided with an eccentric cam for reciprocating the pistons, a cover-side support section on one side of the eccentric cam, a housing-side support section on the other side thereof and a driven-side magnet of the magnetic coupling on the end of the housing-side support section; a first bearing bush for supporting the cover-side support section in the cover; and a second bearing bush for supporting the housing-side support section in the pump housing; the reciprocation of the pistons causing intake of low-viscosity fuel through the intake side passages and discharge thereof through the discharge side passages; the method comprising a step of preparing a subassembly by fitting the first bearing bush in the pump housing member, fitting the cover-side support section of the pump shaft into the first bearing bush and fitting the second bearing bush on the housing-side support section of the pump shaft; and a step of joining the subassembly and the cover.

In a preferred mode of the method, the first bearing bush is fitted to extend from within the pump housing member to within the cover, the second bearing bush is fitted on the housing-side support section by being forced into the end of the pump housing member opposite from the cover, the fitting force of one of the bearing bushes being light, and said one of the bearing bushes is restrained by a retainer.

In the radial piston pump for low-viscosity fuel according to the first aspect of the invention, an improvement in the fuel paths inside the pump enables the intake valves and the discharge valves to be formed on a single leaf valve member. Thus only one leaf valve member is required where two leaf valve members, an intake side leaf valve member and a discharge side leaf valve member, were required in the prior-art radial piston pump for low-viscosity fuel. Moreover, since the pump as a whole needs to support only a single leaf valve member, it can be constituted of as few as two structural bodies as the required minimum. As a result, the number of components can be reduced, the axial alignment precision increased, the number of assembly steps reduced and the production cost lowered.

Moreover, the length of the pump in the axial direction of the pump shaft can shortened, the problem of cylinder hole deformation can be eliminated by appropriate selection of the structural means for overall fastening of the pump housing, heat generated at the points of sliding friction between the pistons and the eccentric cam shaft can be removed by the cooling effect of the fuel, and the pump performance and reliability can be enhanced.

In the radial piston pump for low-viscosity fuel according to the second aspect of the invention, since the fuel inlets and outlets (intake valves and discharge valves) and the overflow ports are all formed in a single plane in the leaf valve member, the tubing associated with the inlets, outlets and overflow ports can be simplified. As a result, the pump can be efficiently assembled and can also be reduced in size owing to the elimination of the intake port members and the like which project radially from the pump housing of the prior-art radial piston pumps for low-viscosity fuel.

In addition, the formation of the intake valves, discharge valves and overflow ports in a single plane in the leaf valve member makes it possible to adopt a configuration in which the sucked in fuel is first used to lubricate and cool the bearing and sliding contact portions of the pump shaft and is then returned to the intake passage side for supply to the pistons. As a result, all of the fuel can be effectively utilized for lubrication and cooling.

Further, since the intake valves and the discharge valves are formed in a single leaf valve member, the axial length of the pump shaft can be made shorter than in the case of the conventional radial pump in which the two types of valves are provided at separate locations.

In the method for assembling a radial piston pump for low-viscosity fuel according to the third aspect of the invention, the first bearing bush, the second bearing bush and the pump shaft are first inserted into the pump housing, which is the pump portion in which the highest fuel pressure is generated, and the housing including these members is then joined with the cover. As a result, the pump housing and the cover are joined with the sections of the pump shaft on the opposite sides of the eccentric cam fastened in their final position. This increases the efficiency with which the pump can be assembled and improves the axial alignment of the pump shaft.

After radial piston pump has been assembled by the method according the third aspect of the invention, it can be easily disassembled for maintenance and repair insofar as one or the other of the bearing bushes is fitted in the pump housing with light fitting force. Since the bearing bushing inserted with light fitting force is held in place by a retainer, moreover, there is no danger of its falling out. The assembly and disassembly operations can therefore be conducted with high efficiency.

DETAILED DESCRIPTION OF THE PREFERRED EMBODIMENTS

A first embodiment of the radial piston pump for low-viscosity fuel according to the first aspect of the invention will be explained with reference to FIGS. 7 to 13. The description of this and later embodiments is in general made with respect to the passages and the like associated with a single piston on the understanding that similar arrangements and operations also apply to the other cylinders.

Figure 7:
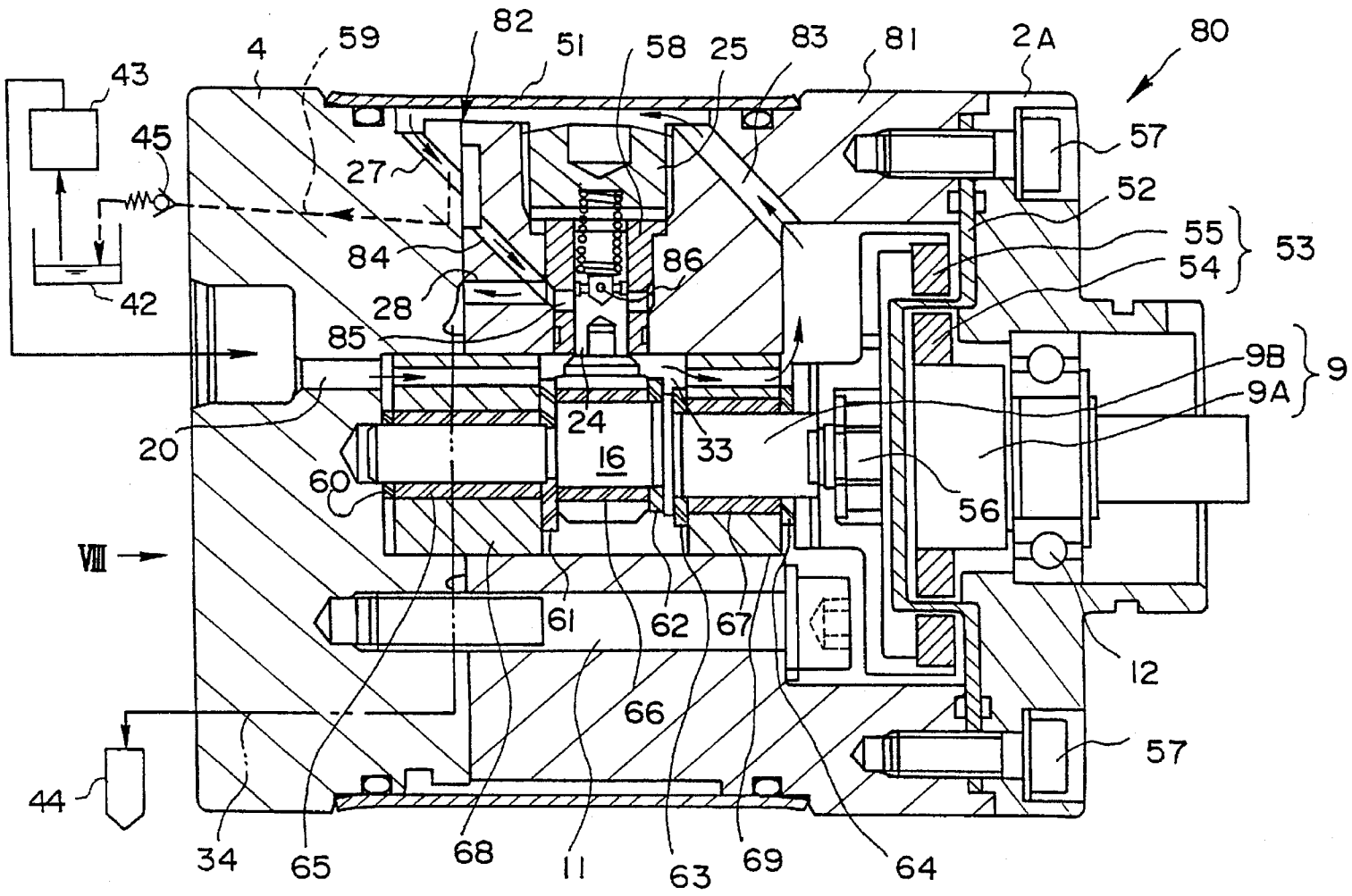
FIG. 7 is an overall sectional view of a radial piston pump for low-viscosity fuel 80 which is a first embodiment of the first aspect of the invention.

FIG. 7 shows an overall sectional view of the radial piston pump for low-viscosity fuel according to the first embodiment of the first aspect of the invention, in which it is designated by reference numeral 80. The radial piston pump for low-viscosity fuel 80 is basically an improvement on the radial piston pump for low-viscosity fuel 50 shown in FIG. 5, which is of the type having an outer cover 51. It comprises a drive-side housing member 2A (first pump housing member), a fixed cylinder 81 (unitary second pump housing member corresponding to the driven-side housing member 2B and the fixed cylinder 3 in FIG. 5), a cover 4 (third pump housing member), the outer cover 51 and a single leaf valve 82 (FIG. 9) disposed between the fixed cylinder 81 and the cover 4.

Figure 8:
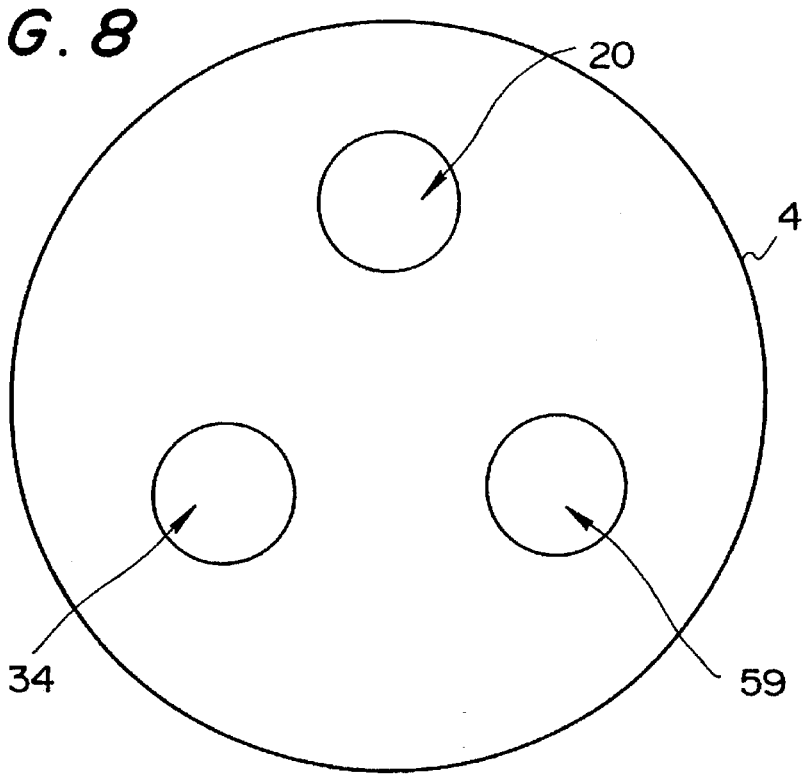
FIG. 8 is a view taken in the direction of the arrow VIII in FIG. 7.

FIG. 8 is a view taken in the direction of the arrow VIII in FIG. 7 for showing the relative positions of the openings of an intake passage 20, a discharge passage 34 and a recirculation passage 59.

Fuel passes from a fuel tank 42, through the intake passage 20 in the cover 4, into an annular chamber 33 for intake and lubrication, through an indirect passage 83 formed inside the fixed cylinder 81 and under the outer cover 51, to an intake side passage 27. Thus, differently from in the prior art configuration of FIG. 5, the fuel circles around the piston 24 and reaches the leaf valve member 82 from the opposite side.

After passing through the leaf member 82, the fuel flows through a merge passage 84 to an intake/discharge passage 85 of a cylinder liner 58 and to an intake/discharge port 86 of the piston 24, whereafter the pump action of the piston 24 sends it through a discharge side passage 28 and the discharge passage 34 to an injector 44.

Figure 1:
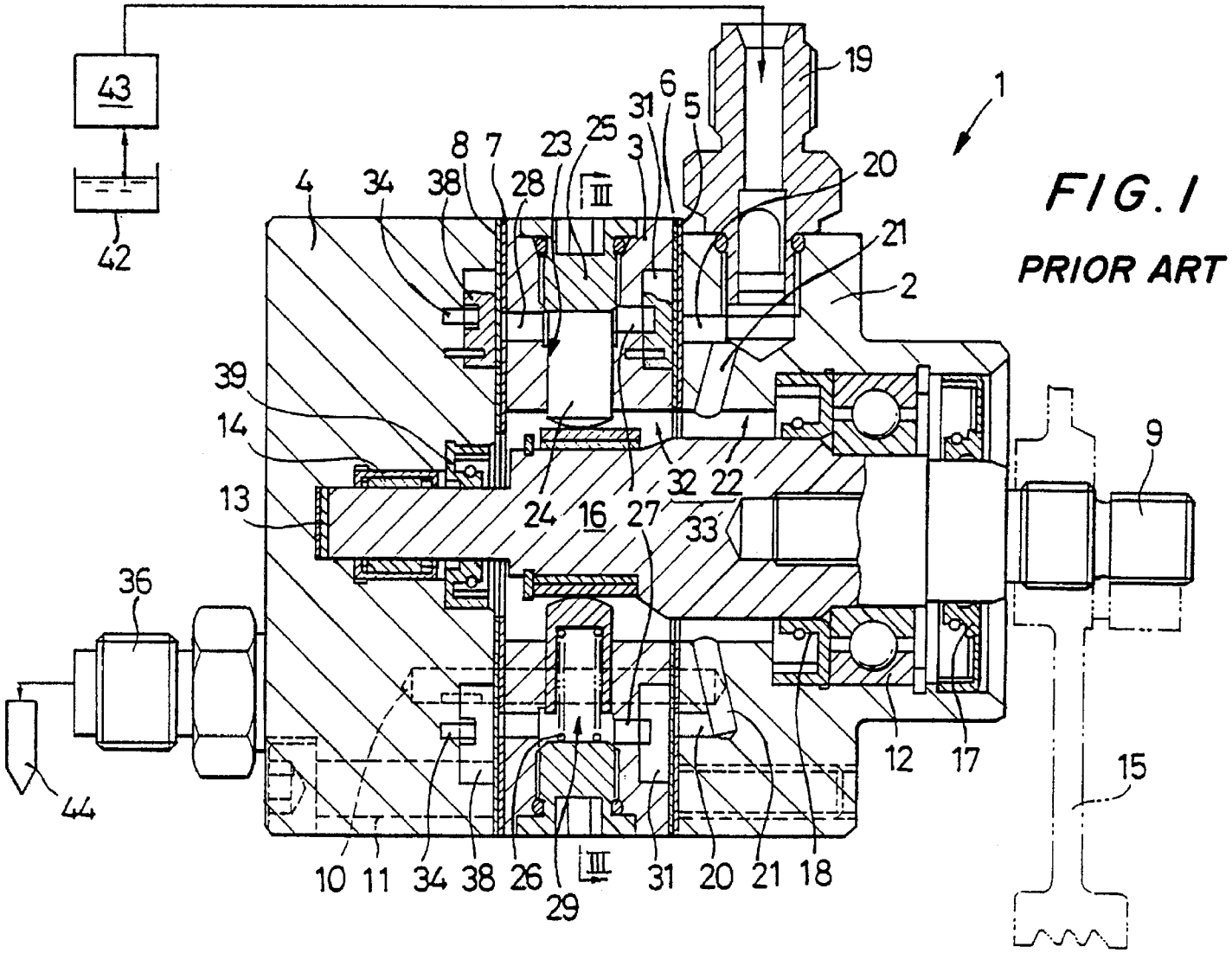
FIG. 1 PRIOR ART
FIG. 1 is an overall sectional view of a radial piston pump for low-viscosity fuel 1 according to the prior art.
Figure 2:
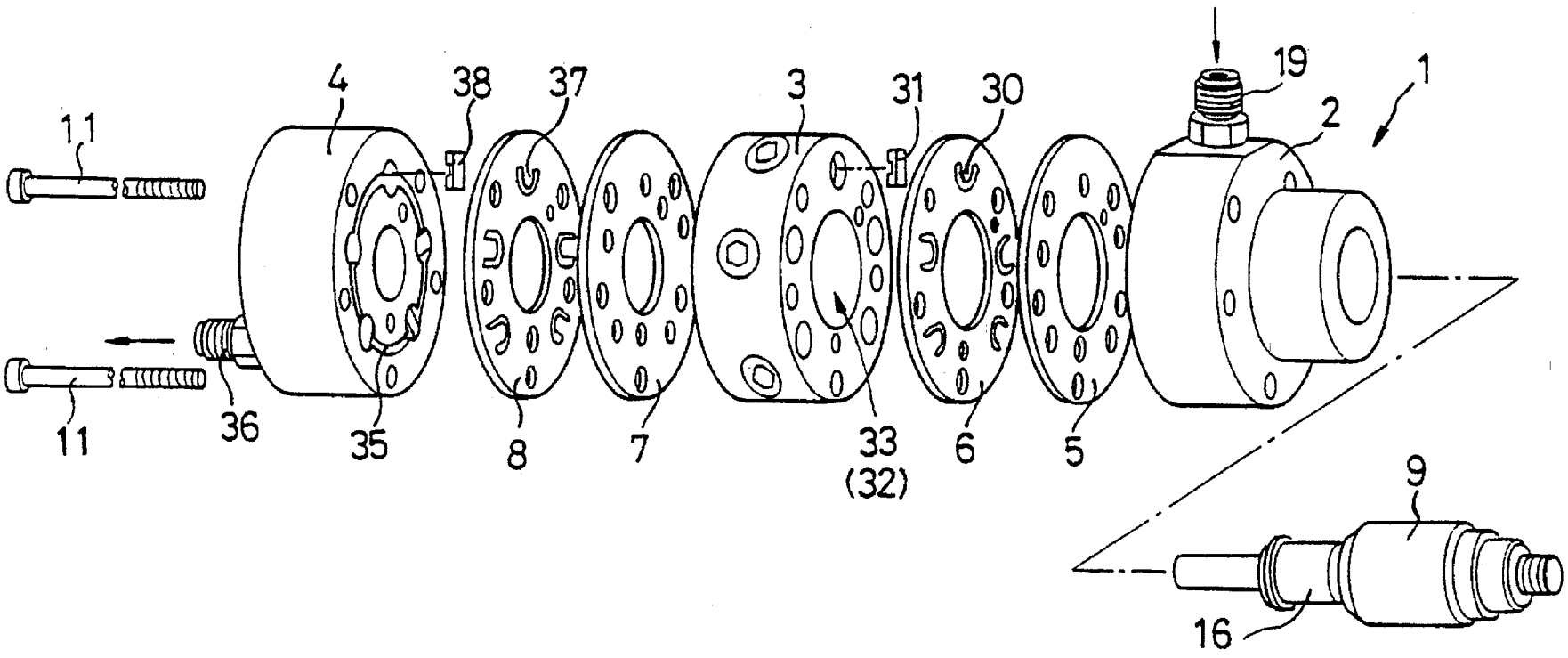
FIG. 2 PRIOR ART
FIG. 2 is an exploded perspective view of the radial piston pump for low-viscosity fuel 1 of FIG. 1.
Figure 3:
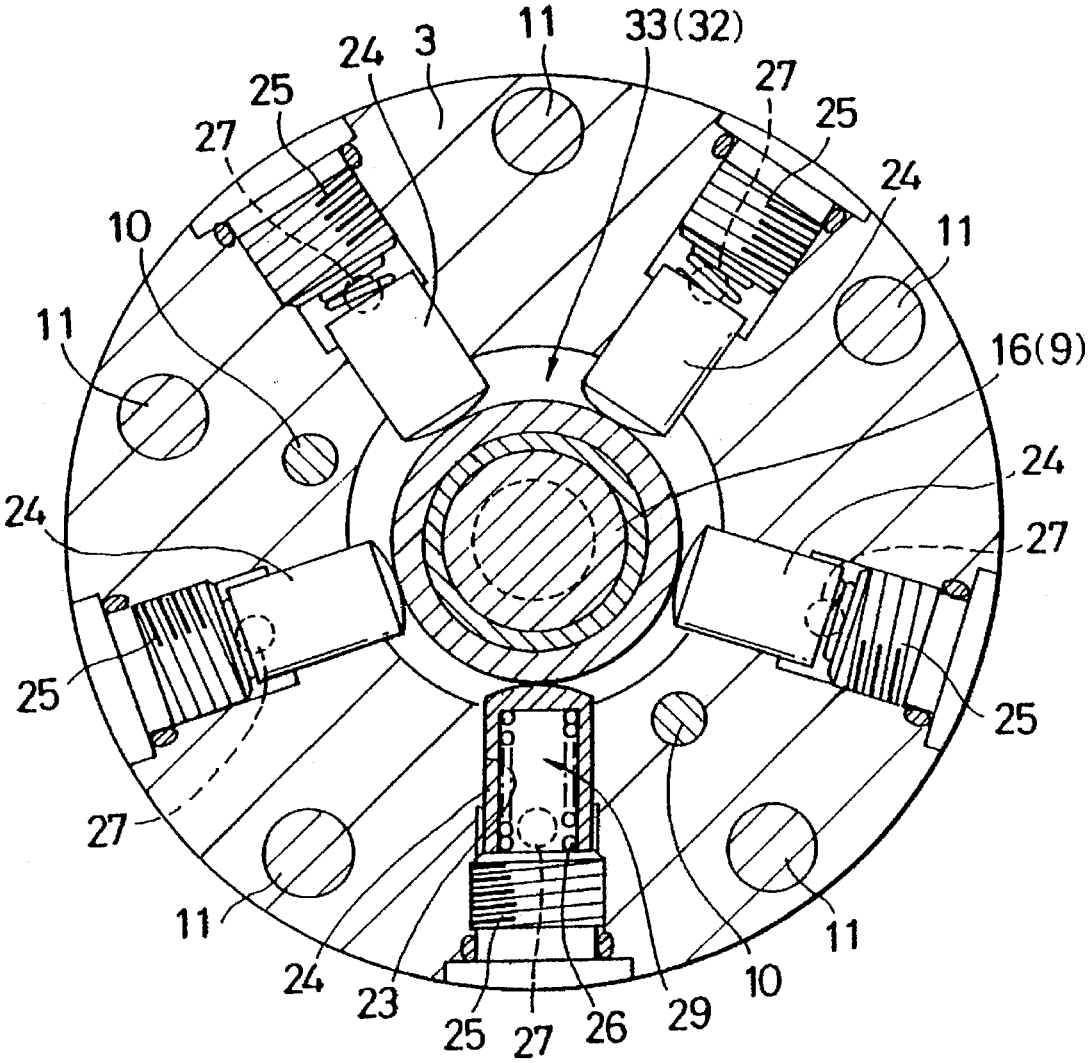
FIG. 3 PRIOR ART
FIG. 3 is a sectional view taken along line III—III of FIG. 1.
Figure 4:
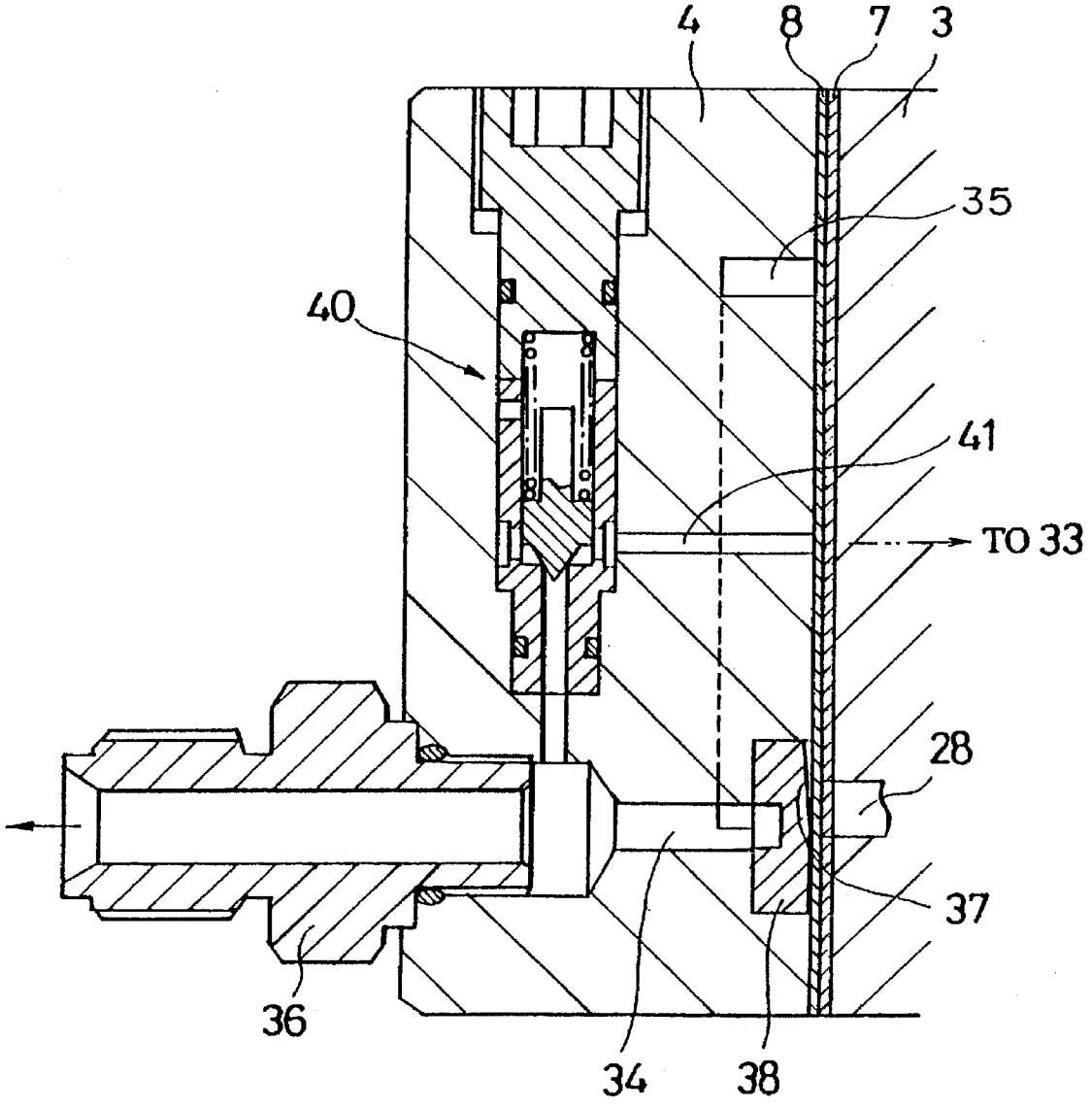
FIG. 4 PRIOR ART
FIG. 4 is a vertical sectional view of a relief valve 40 of the radial piston pump for low-viscosity fuel 1 of FIG. 1.
Figure 9:
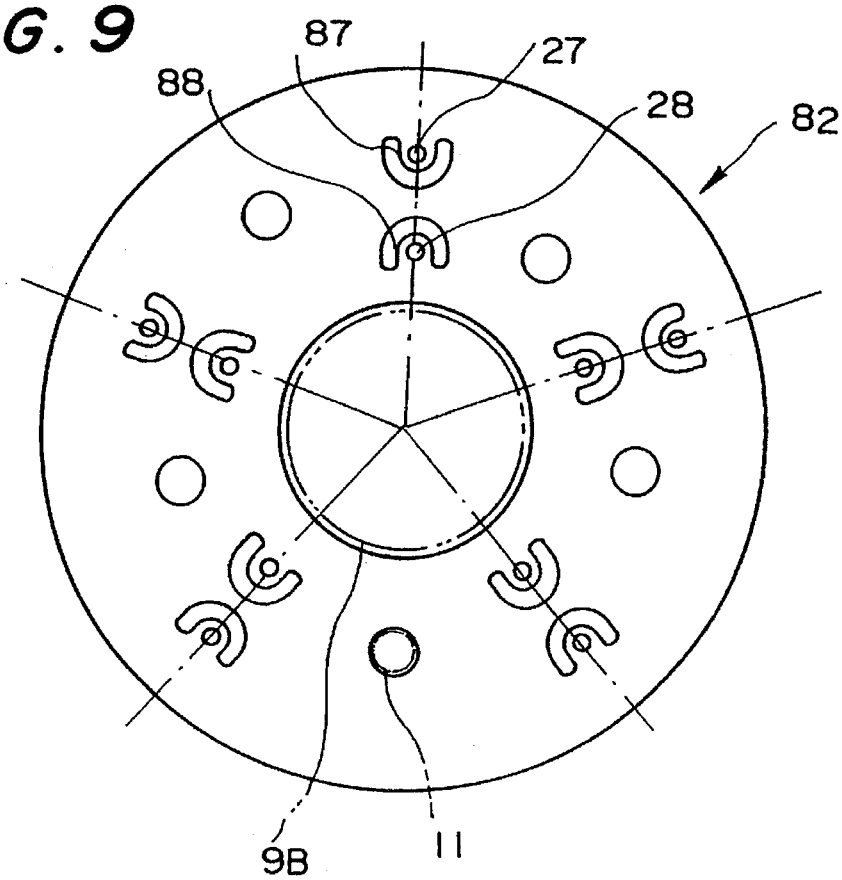
FIG. 9 is a front view of a leaf valve member 82 of the radial piston pump for low-viscosity fuel 80 of FIG. 7.

As shown in the front view of FIG. 9, the leaf valve member 82 has a number of pairs (five in the illustrated example) of intake valves 87 and discharge valves 88 spaced at regular angular intervals. The members of each pair are aligned radially. Similarly to the intake valve 30 and the discharge valves 37 referred to earlier with reference to FIG. 2, the intake valves 87 and the discharge valves 88 are formed as tongue-shaped springs.

The intake valves 87 open and close communication between the intake side passages 27 and the merge passages 84, and the discharge valves 88 open and close communication between the discharge side passages 28 and the discharge passage 34.

The leaf valve member 82 can be modified in various ways as shown in FIGS. 10 to 13.

Figure 10:
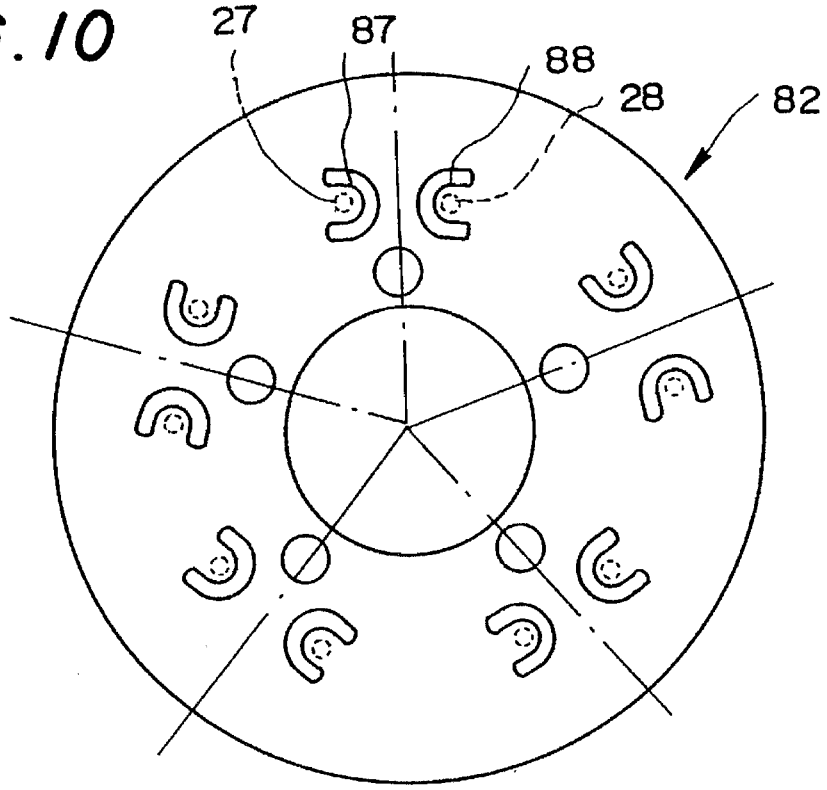
FIG. 10 is a front view of a modification of the leaf valve member 82 of the radial piston pump for low-viscosity fuel 80 of FIG. 7.
Figure 11:
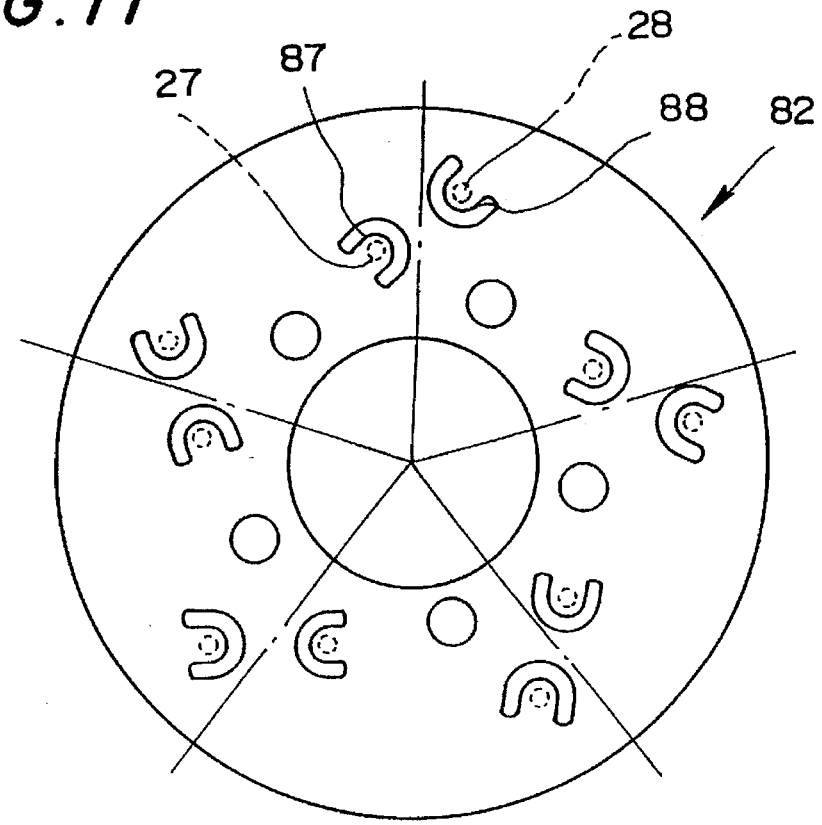
FIG. 11 is a front view of a modification of the leaf valve member 82 of the radial piston pump for low-viscosity fuel 80 of FIG. 7.

In the modification shown in FIG. 10, the intake valves 87 and discharge valves 88 of each pair are offset from each other in the circumferential direction, while in the modification shown in FIG. 11 they are offset from each other in the radial direction and the line passing through their centers is inclined at a prescribed angle relative to the radial direction of the leaf valve member 82. The configuration best suited to the layout of the intake side passages 27 and the discharge side passages 28 is selected.

Figure 12:
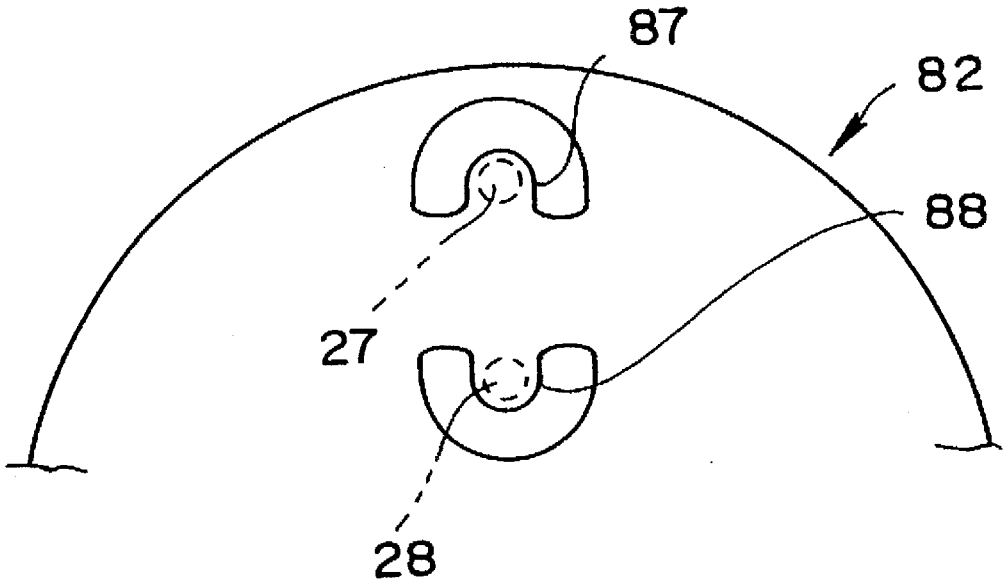
FIG. 12 is a front view of a modification of the leaf valve member 82 of the radial piston pump for low-viscosity fuel 80 of FIG. 7.
Figure 13:
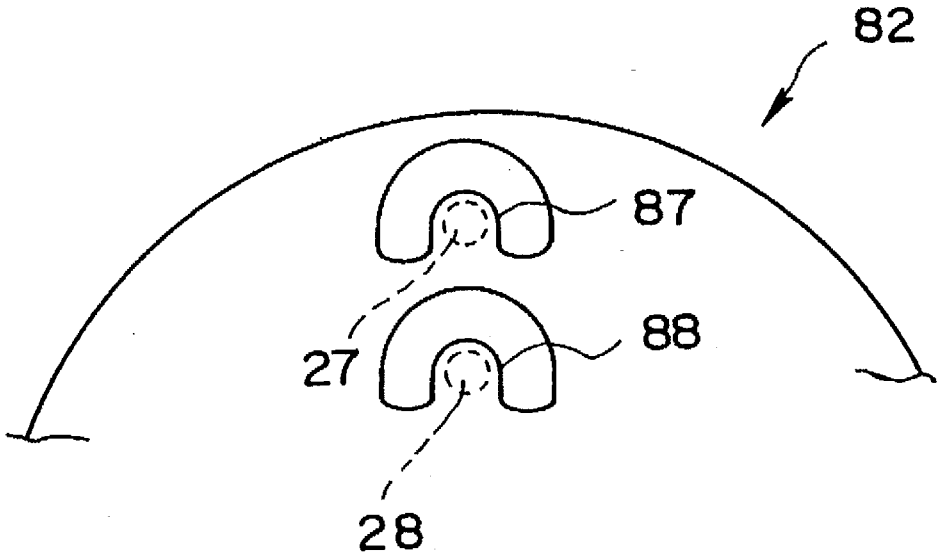
FIG. 13 is a front view of a modification of the leaf valve 82 of the radial piston pump for low-viscosity fuel 80 of FIG. 7.

FIG. 12 shows the intake valves 87 and the discharge valves 88 facing in opposite directions, while FIG. 13 shows them facing in the same direction.

Figure 5:
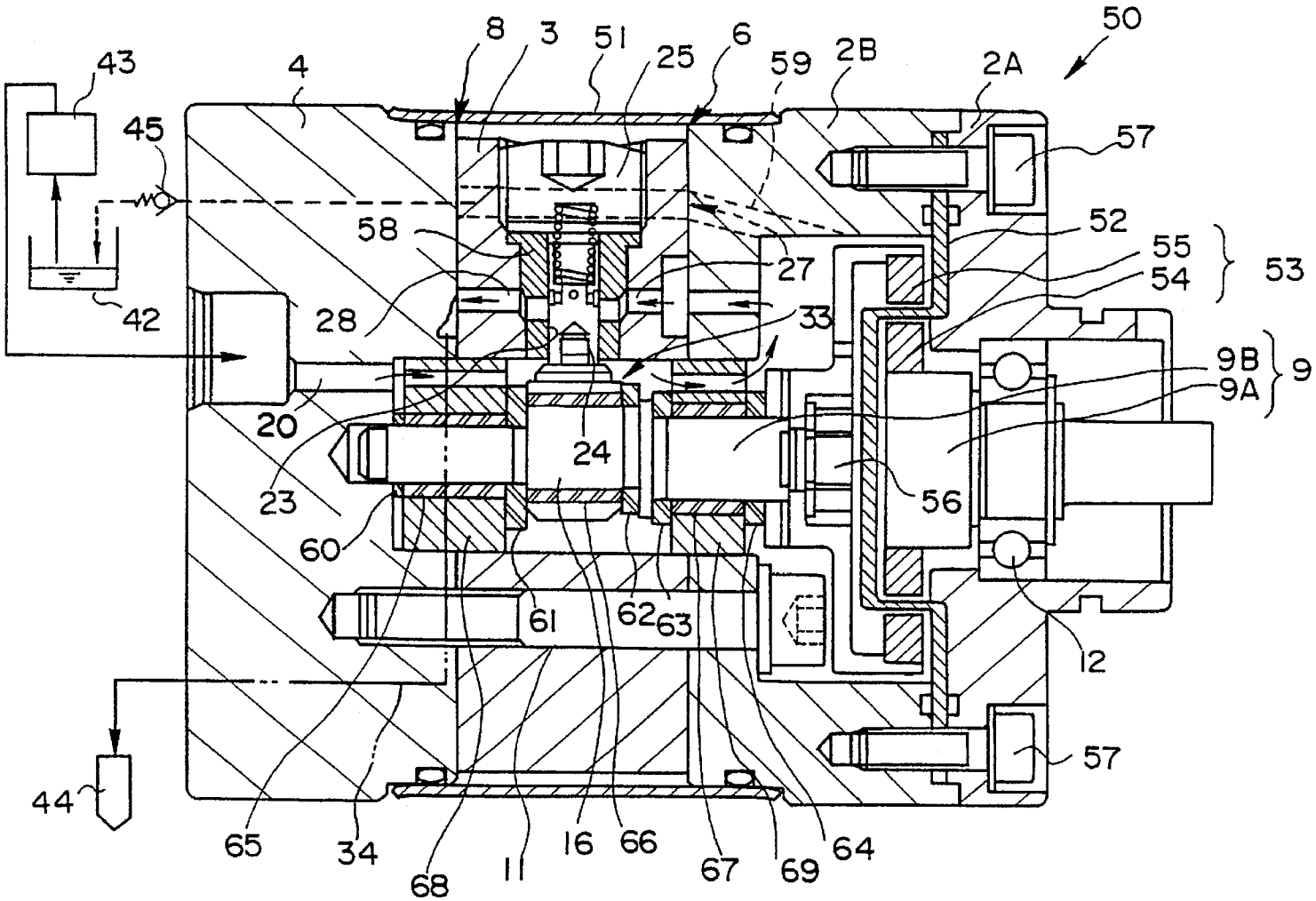
FIG. 5 PRIOR ART
FIG. 5 is an overall sectional view of a prior-art radial piston pump for low-viscosity fuel 50 having an outer cover 51.

Differently from the prior art radial piston pump for low-viscosity fuel 50 of FIG. 5, in which the pump housing has a four-body structure consisting of the driveside housing member 2A, the driven-side housing member 2B, the fixed cylinder 3 and the cover 4 bolted together by the stud bolts 11 and the housing bolts 57, the housing of the radial piston pump for low-viscosity fuel 80 configured in the manner described in the foregoing is a three-body structure consisting of the drive-side housing member 2A, the fixed cylinder 81 and the cover 4 bolted together by stud bolts 11 and housing bolts 57. In addition, it has only a single leaf valve member 82. As a result, the radial piston pump for low-viscosity fuel 80 has fewer components, is therefore easier to assemble, can be assembled with more precise axial alignment, and achieves improvements in pump performance and reliability.

Figure 14:
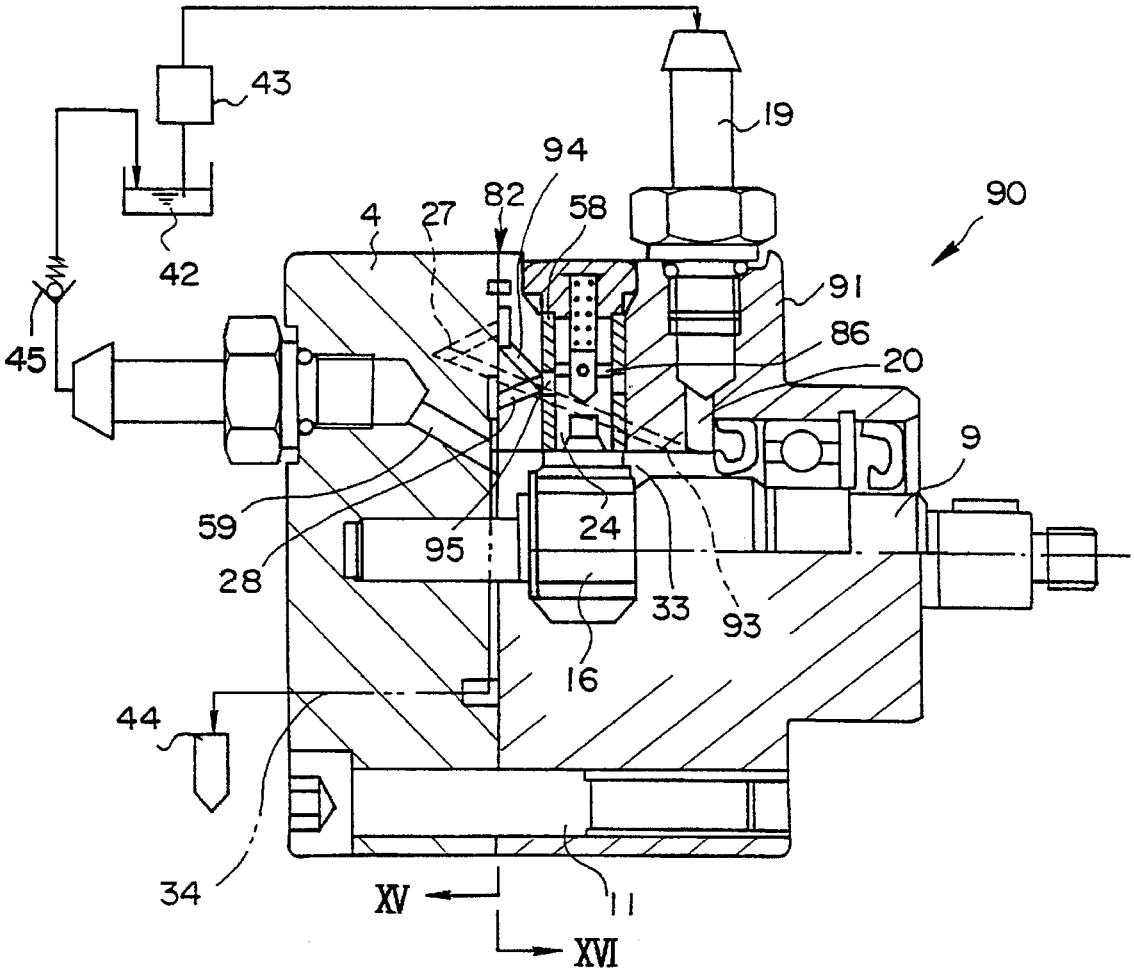
FIG. 14 is an overall sectional view of a radial piston pump for low-viscosity fuel 90 which is a second embodiment of the first aspect of the invention.
Figure 15:
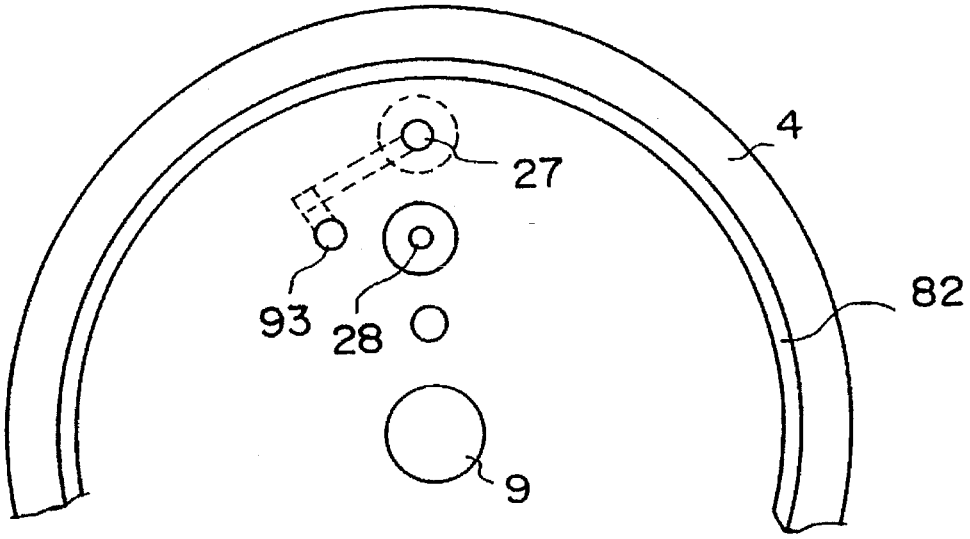
FIG. 15 is a view taken in the direction of the arrow XV in FIG. 14.
Figure 16:
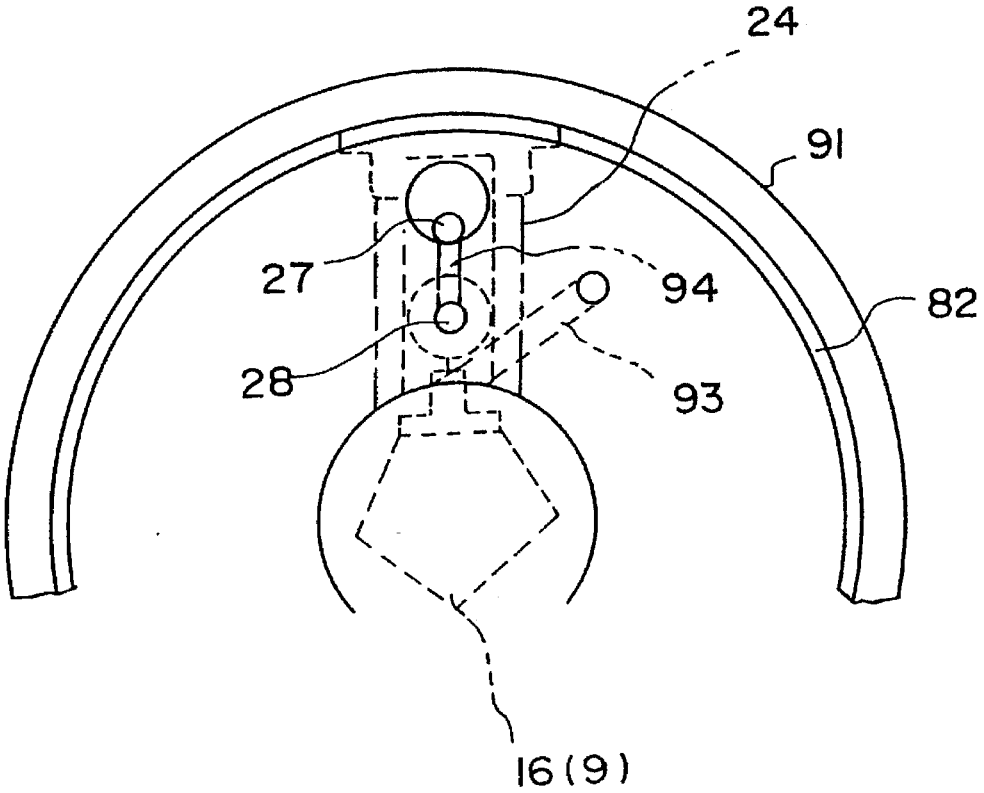
FIG. 16 is a view taken in the direction of the arrow XVI in FIG. 14.

FIG. 14 is an overall sectional view of a radial piston pump for low-viscosity fuel 90 which is a second embodiment of the first aspect of the invention, FIG. 15 is a view taken in the direction of the arrow XV in FIG. 14. and FIG. 16 is a view taken in the direction of the arrow XVI in FIG. 14. The radial piston pump for low-viscosity fuel 90 is basically an improvement on the radial piston pump for low-viscosity fuel 70 shown in FIG. 6, which is of the type not having an outer cover 51. It comprises a housing member 91 (unitary first housing member corresponding to the housing member 2 and the fixed cylinder 3 in FIG. 6), a cover 4 (second pump housing member) and a leaf valve member 82 disposed between the housing member 91 and the cover 4.

Fuel passes from a fuel tank 42, through an intake passage 20 in the housing member 91, into an annular chamber 33 for intake and lubrication, through an indirect passage 93 passing through the housing member 91 and the cover 4 and, as in the radial piston pump for low-viscosity fuel 80 of FIG. 7, to an intake side passage 27, the leaf valve member 82, a merge passage 94, an intake/discharge passage 95 of a cylinder liner 58 and an intake/discharge port 86 of the piston 24, whereafter the pump action of the piston 24 sends it through a discharge side passage 28 and a discharge passage 34 to an injector 44.

Figure 6:
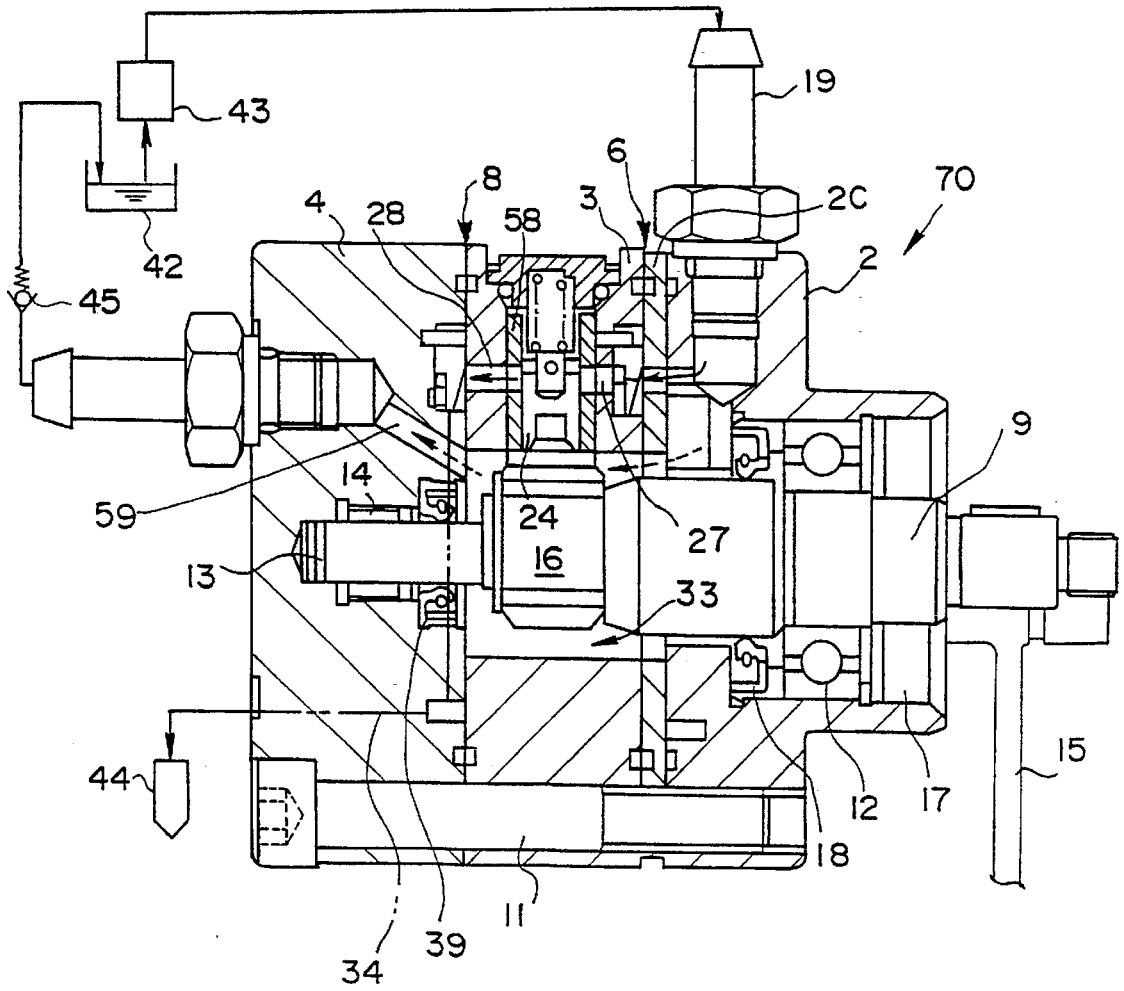
FIG. 6 PRIOR ART
FIG. 6 is an overall sectional view of a prior-art radial piston pump for low-viscosity fuel 70 without the outer cover 51.

Differently from the prior art radial piston pump for low-viscosity fuel 70 of FIG. 6 in which the pump housing has a four-body structure consisting of the housing member 2, the intermediate block 2C, the fixed cylinder 3 and the cover 4 bolted together by the stud bolts 11, the housing of the radial piston pump for low-viscosity fuel 90 configured in the manner described in the foregoing is a two-body structure consisting of the housing member 91 and the cover 4 bolted together by stud bolts 11. In addition, it has only a single leaf valve member 82. Thus, like the radial piston pump for low-viscosity fuel 80, the radial piston pump for low-viscosity fuel 90 has fewer components, is therefore easier to assemble, and can be assembled with higher precision.

Moreover, since the two-body structure sandwiching the leaf valve member 82 makes it possible to shorten the length of radial piston pump for low-viscosity fuel 90 in the axial direction of the pump shaft 9, the pump can be reduced in overall size.

Figure 17:
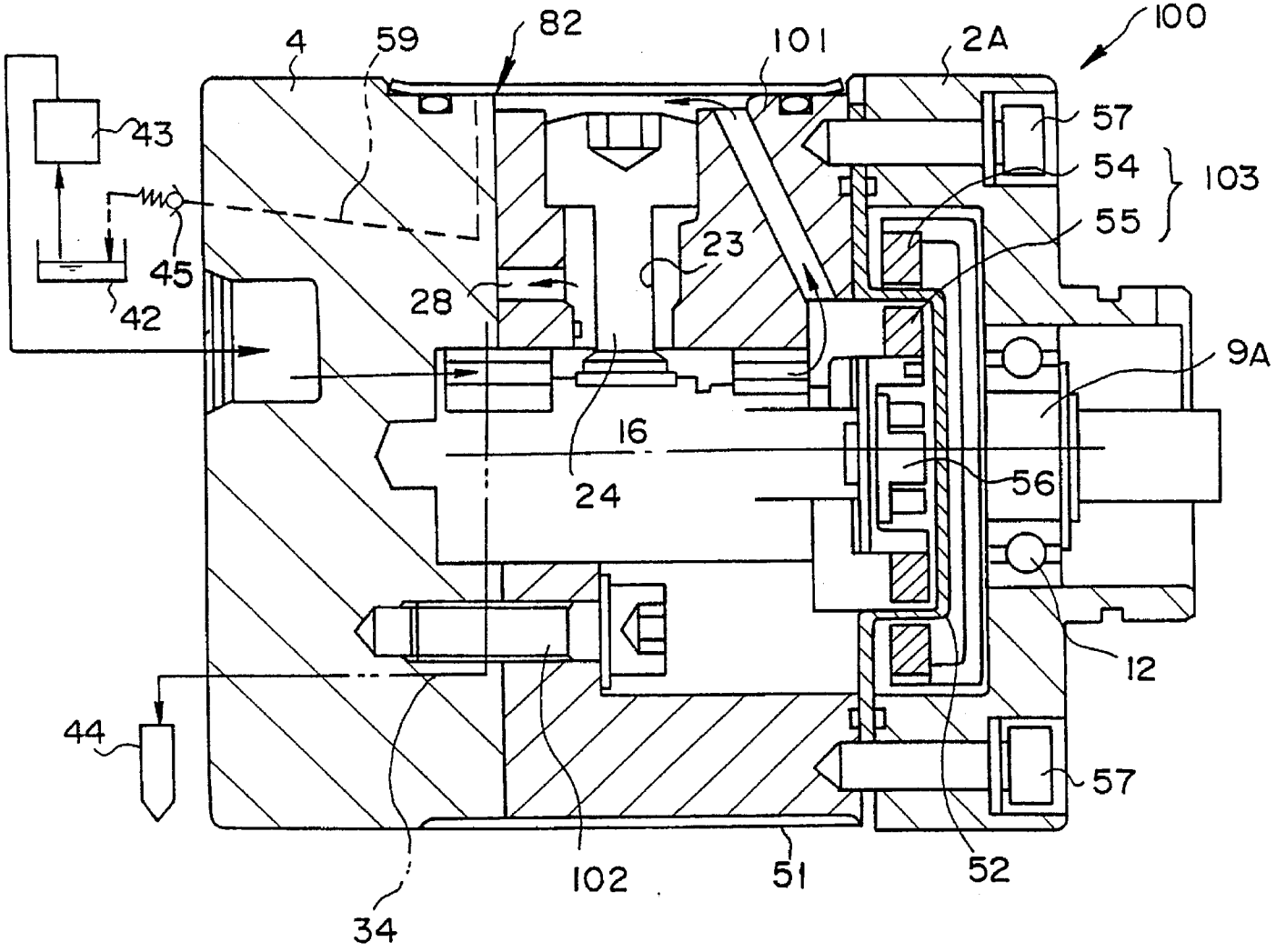
FIG. 17 an overall perspective view of a radial piston pump for low-viscosity fuel 100 which is a third embodiment of the first aspect of the invention.

FIG. 17 is an overall sectional view of a radial piston pump for low-viscosity fuel 100 which is a third embodiment of the first aspect of the invention. The radial piston pump for low-viscosity fuel 100 is basically an improvement on the radial piston pump for low-viscosity fuel 50 shown in FIG. 5, which is of the type having an outer cover 51. Its internal fuel paths and pump action are similar to those of the radial piston pump for low-viscosity fuel 80 of FIG. 7. However, it differs from the radial piston pump for low-viscosity fuel 80 in the manner in which its fixed cylinder 101 (corresponding to the fixed cylinder 81) and the cover 4 are fastened together by stud bolts 102 and in the configuration of its magnetic coupling 103 (corresponding to the magnetic coupling 53).

Specifically, since the stud bolts 102 fasten together a body formed of only two components, namely the fixed cylinder 101 and the cover 4, the fixed cylinder 101 is not squeezed between left and right left components (the cover 4 and the drive-side housing member 2A). Thus, differently from in the radial piston pump for low-viscosity fuel 50 of FIG. 5 in which three components, the driven-side housing member 2B, the fixed cylinder 3 and the cover 4, are bolted together, there is no danger of the pistons 24 and the cylinder liners 58 being deformed by the fastening force.

In the magnetic coupling 103, moreover, since the drive-side magnet 54 is disposed radially outward of the driven-side magnet 55, the bolt 56 is not an obstacle to fixed cylinder 101 size reduction. The overall length of the radial piston pump for low-viscosity fuel in the axial direction can therefore be shortened.

In the radial piston pump for low-viscosity fuel according to the first aspect of the invention, the shape and layout of the fuel paths for enabling formation of the intake valves and the discharge valves in a single leaf valve member can be designed as appropriate for the pump housing concerned.

A first embodiment of the radial piston pump for low-viscosity fuel according to the second aspect of the invention will now be explained with reference to FIGS. 18 to 21.

Figure 18:
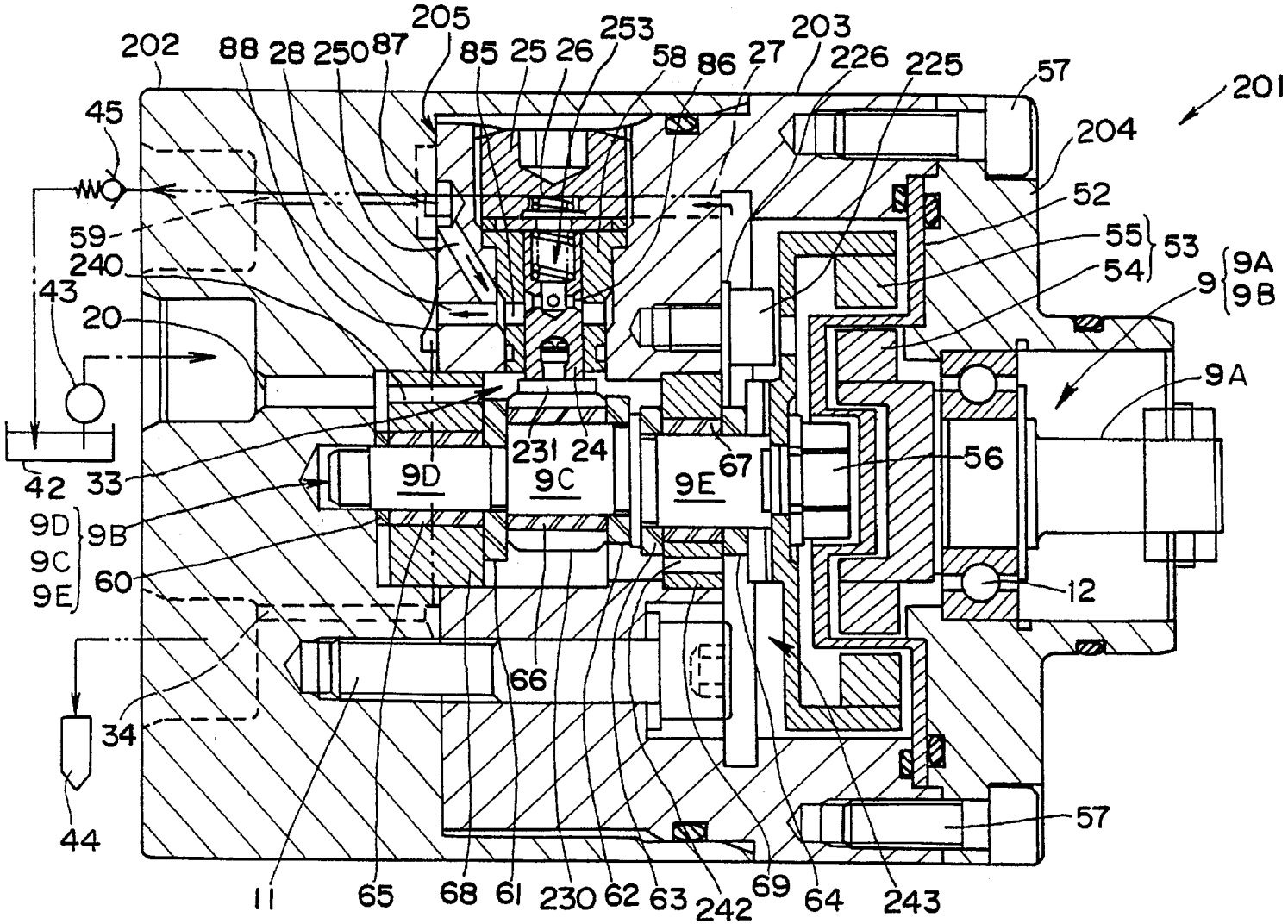
FIG. 18 is sectional view of a radial piston pump for low-viscosity fuel 201 which is a first embodiment of the second aspect of the invention.

FIG. 18 shows an overall sectional view of the radial piston pump for low-viscosity fuel, in which it is designated by reference numeral 201. Like the radial piston pump for low-viscosity fuel 80 (FIG. 7) and the radial piston pump for low-viscosity fuel 100 (FIG. 17), the radial piston pump for low-viscosity fuel 201 also has a three-body structure. It comprises a cover 202 (unitary third housing member corresponding to the outer cover 51 and the cover 4 in FIG. 5), a pump housing member 203 (second housing member corresponding to the fixed cylinder 81 in FIG. 7), a flange 204 (first housing member corresponding to the drive-side housing member 2A in FIG. 7), a leaf valve member 205 (corresponding to the leaf valve member 82 in FIG. 7) disposed between the cover 202 and the pump housing member 203, and a pump shaft 9.

The cover 202 is formed with an intake passage 20, an overflow passage 59 (corresponding to the recirculation passage 59 of FIG. 7) and a discharge passage 34 and is fastened to the pump housing member 203 by stud bolts 11. In addition, the pump housing member 203 and the flange 204 are fastened together by housing bolts 57.

Similarly to the arrangement shown in FIG. 7, the pump shaft 9 is divided into a drive-side pump shaft 9A and a driven-side pump shaft 9B which are located on opposite sides of the partition 52 and linked by a magnetic coupling 53 straddling the partition 52.

The magnetic coupling 53 comprises a drive-side magnet 54 attached to the drive-side pump shaft 9A and a driven-side magnet 55 attached to the driven-side pump shaft 9B by a bolt 56.

The drive-side pump shaft 9A is rotatably supported by a ball bearing 12 (radial bearing) and is driven by an engine or the like (not shown).

The driven-side pump shaft 9B is formed at its center portion with an eccentric cam 9C and at its opposite ends with a cover-side support section 9D and a housing-side support section 9E whose axes coincide with that of the eccentric cam 9C.

The cover-side support section 9D is rotatably supported via a first roller bearing 65 and a washer 60 within a first bearing bush 68 force-fitted in a hole extending from the cover 202 into the pump housing member 203.

The housing-side support section 9E is rotatably supported via a second roller bearing 67 and washers 63, 63 at the opposite ends thereof within a second bearing bush 69 force-fitted into a hole at the other end of the pump housing member 203.

Figure 19:
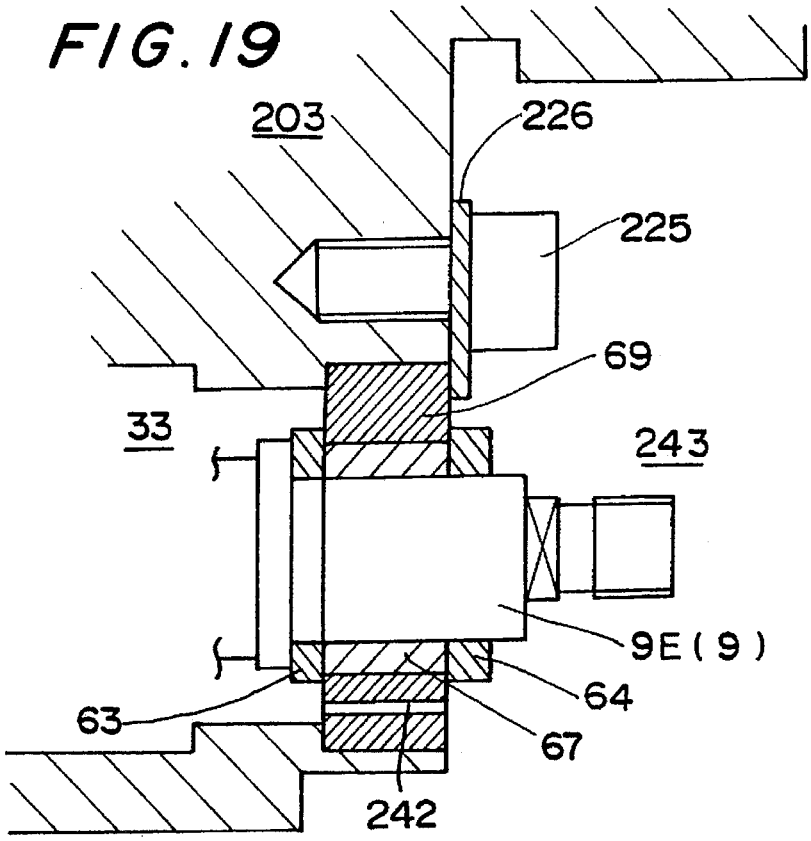
FIG. 19 is an enlarged sectional view of an essential portion of a housing-side support section 9E for a pump shaft 9 of the radial piston pump for low-viscosity fuel 201 of FIG. 18.

As best shown in the enlarged view of an essential portion of the housing-side support section 9E in FIG. 19, a retainer 226 is fastened to the exterior of the pump housing member 203 by bolts 225 for holding the second bearing bush 69 between itself and the pump housing member 203. With this arrangement, the second bearing bush 69 can be prevented from falling out even when inserted with minimal force.

Figure 20:
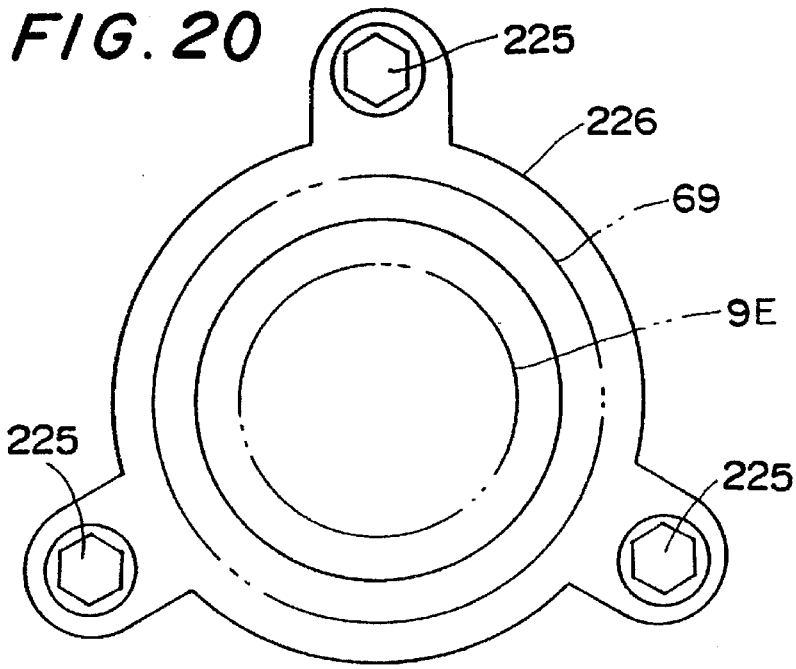
FIG. 20 is side view showing the positional relationship between the housing-side support section 9E, a second bush 69 and a retainer 226 of the radial piston pump for low-viscosity fuel 201 of FIG. 18.

FIG. 20 is side view showing the positional relationship between the housing-side support section 9E, the second bush 69 and the retainer 226.

The eccentric cam 9C is fitted with a third roller bearing 66, washers 61, 62 at opposite ends thereof, a bearing bush 230 and a drive shoe 231.

The portion of the pump housing member 203 opposite the drive shoe 231 is provided with cylinder barrels 58 (cylinder liners), pistons 24 and plugs 25 which are disposed radially within a plane perpendicular to the axis of the pump shaft 9. The pistons 24 are urged into contact with the drive shoe 231 by the force of piston springs 26 provided inside the cylinder barrels 58.

Gasoline or other low-viscosity fuel is supplied to the intake passage 20 from a fuel tank 42 by a feed pump 43 and is discharged through the discharge passage 34 by the pump action of the eccentric cam 9C to be sprayed from a fuel injection nozzle 44 (injector). Fuel overflowing from the overflow passage 59 is returned to the fuel tank 42 through a check valve 45.

The fuel paths within the cover 202 and the pump housing member 203 will now be explained in detail.

The fuel from the intake passage 20 passes through a first bush hole 240 in the first bearing bush 68 into an annular chamber 33 surrounding the eccentric cam 9C. It then passes through a second bush hole 242 in the second bearing bush 69 into a coupling chamber 243, thus reaching the intake side passages 27 (only one shown).

Figure 21:
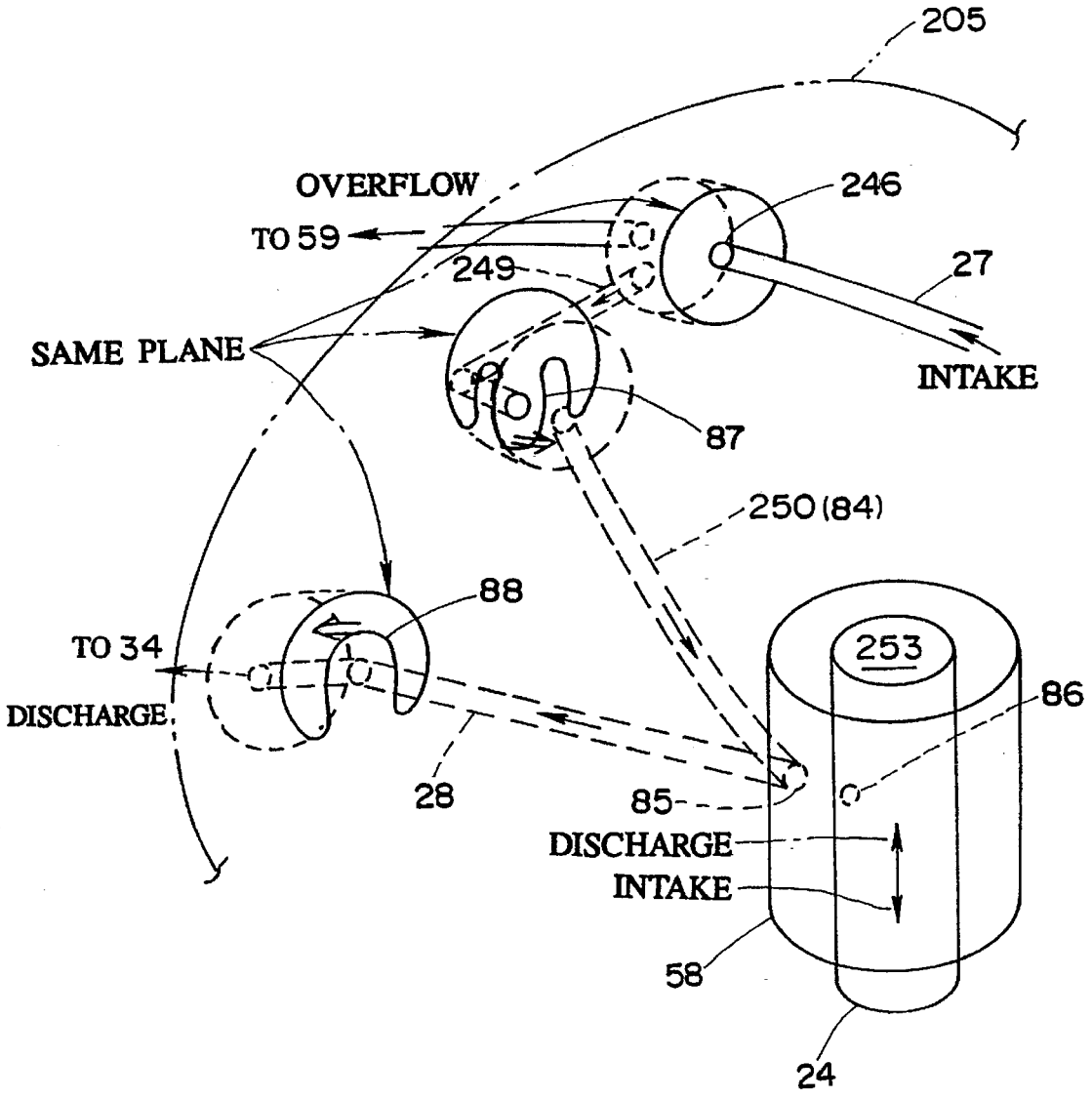
FIG. 21 is a perspective view schematically showing a fuel path extending from an intake side passage 27 through a cylinder barrel 58 and a discharge side passage 28 to a discharge passage 34 in the radial piston pump for low-viscosity fuel 201 of FIG. 18.

FIG. 21 is a perspective view schematically showing a fuel path extending from an intake side passage 27 through a cylinder barrel 58 and a discharge side passage 28 to the discharge passage 34. The leaf valve member 205 is formed within one and the same plane with overflow ports 246, intake valves 87 and discharge valves 88 (only one of each shown).

As shown in FIG. 21, the overflow port 246 is communicated with the intake side passage 27 formed in the pump housing member 203 and is communicated with the intake valve 87 through a first communicating passage 249 formed in the cover 202 and is further communicated with an intake/discharge window 85 (intake/discharge passage) in the cylinder liner 58 through a second communicating passage 250 (corresponding to the merge passage 84 in FIG. 7).

The intake/discharge window 85 communicates with a pressurization chamber 253 (also see FIG. 18) through an intake/discharge port 86 of the piston 24.

Fuel discharged by the action of the piston 24 passes from the intake/discharge window 85, through the discharge side passage 28 formed in the pump housing member 203 and the discharge valve to the discharge passage 34.

The area of the overflow port 246 is determined to overflow a prescribed percentage of the fuel from the intake side passage 27.

Since the intake valves 87 can bend only in the direction of fuel intake, the fuel is able to flow in the intake direction from the first communicating passages 249 to the second communicating passages 250.

Since the discharge valves 88 can bend only in the fuel discharge direction, the fuel is able to flow in the discharge direction from the discharge side passages 28 to the discharge passage 34.

In the radial piston pump for low-viscosity fuel 201 configured in the foregoing manner, when the pistons 24 move centripetally during the intake stroke (when the piston 24 shown in the figures moves downward), a part of the fuel from the intake side passage 27 overflows through the overflow port 246 to the overflow passage 59, while the intake valves 87 allow the remainder thereof to pass through the first communicating passages 249, the second communicating passage 250, the intake/discharge window 85 and the intake/discharge port 86 into the pressurization chambers 253. The discharge valves 88 are closed during the intake stroke.

When the pistons move centrifugally during the discharge stroke (when the piston 24 shown in the figures moves upward), the pressurization effect of the pressurization chambers 253 and the discharge effect of the discharge valves 88 act to discharge the fuel through the intake/discharge ports 86, the intake/discharge windows 85, the discharge side passages 28 and the discharge valves 88 to the discharge passage 34. The intake valves 87 are closed during the discharge stroke.

As explained in the foregoing, the fuel fed in through the intake passage 20 passes through the annular chamber 33 housing the eccentric cam 9C of the pump shaft 9 and the coupling chamber 243 housing the magnetic coupling 53 and a portion thereof is overflowed to the overflow passage 59 for recirculation. Since the fuel therefore passes through the parts of the bearings where sliding friction occurs before being pressurized and discharged by the action of the pistons 24, the bearings can be adequately lubricated and cooled at the same time that the fuel is being sucked in and discharged.

Moreover, since the overflow ports 246, intake valves 87 and discharge valves 88 which produce the overflow, intake and discharge actions are formed within the same plane of the leaf valve member 205, the radial piston pump for low-viscosity fuel 201 is easier to assemble and can be assembled with higher precision than the prior-art radial piston pumps for low-viscosity fuel in which these members are not in the same plane. This feature also makes it possible to reduce the length of the radial piston pump for low-viscosity fuel 201 in the axial direction of the pump shaft 9.

Other features of the radial piston pump for low-viscosity fuel 201 also contribute to overall size reduction. For example, since the overflow passage 59 which communicates directly with the overflow port 246, the intake passage 20 through which fuel reaches the intake valves 87 and the discharge passage 34 which communicates directly with the discharge side passages 28 can be formed in the cover 202, portions of the radial piston pump for low-viscosity fuel 201 that would otherwise project radially can be eliminated. The need to provide tubing on the outer surface of the radial piston pump for low-viscosity fuel 201 is also eliminated.

Figure 22:
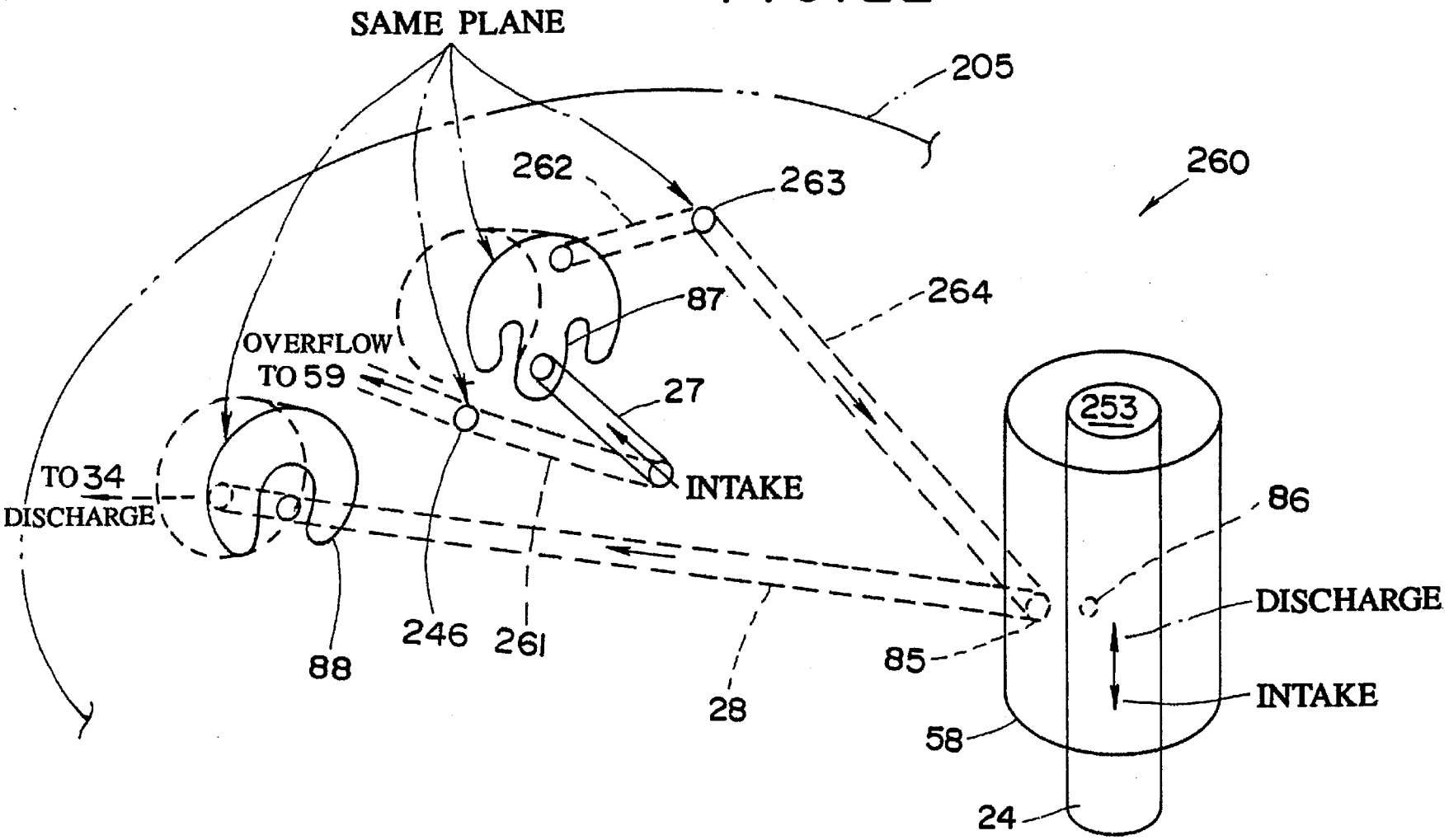
FIG. 22 is a perspective view schematically showing a fuel path of a radial piston pump for low-viscosity fuel 260 which is a second embodiment of the second aspect of the invention.

FIG. 22 is a perspective view schematically showing a fuel path of a radial piston pump for low-viscosity fuel 260 which is a second embodiment of the second aspect of the invention. The radial piston pump for low-viscosity fuel 260 is the same as the radial piston pump for low-viscosity fuel 201 explained above in all respects other than the arrangement of the fuel paths in the vicinity of the leaf valve member 205.

Specifically, the fuel passing through the annular chamber 33, the coupling chamber 243 and the intake side passage 27 associated with a given piston 24 branches into an intake side passage 27 leading to an intake valve 87 (the main passage) and into an overflow side passage 261 leading to an overflow port 246 and the overflow passage 59.

The fuel branching into the intake side passage 27 on the side of the pump housing member 203 passes through the intake valve 87 into a third communicating passage 262 in the cover 202, through an opening 263 formed in the leaf valve member 205 in the same plane as the intake valve 87, through a fourth communicating passage 264 formed in the pump housing member 203 and to the cylinder barrel 58.

Fuel subjected to the intake and discharge actions of the intake/discharge port 86 and pressurization chamber 253 inside the cylinder barrel 58 exits from the intake/discharge window 85 and passes through the discharge side passage 28 and the discharge valve 88 to the discharge passage 34.

Since the overflow ports 246, the intake valves 87, the discharge valves 88 and the openings 263 are formed in the same plane of the leaf valve member 205, the radial piston pump for low-viscosity fuel 260 can be reduced in size for the same reasons as explained earlier in connection with the radial piston pump for low-viscosity fuel 201.

A method for assembling the radial piston pump for low-viscosity fuel in accordance with the third aspect of the invention will now be explained mainly with reference to FIGS. 18 to 20.

When a radial piston pump for low-viscosity fuel is equipped with a magnetic coupling such as the magnetic coupling 53, as in the case of the radial piston pumps for low-viscosity fuel 201 and 260, the pump shaft 9 is divided into two parts linked by the magnetic coupling 53, namely into the driven-side pump shaft 9B on the cover 202 and pump housing member 203 side and the drive-side pump shaft 9A on the flange 204 side. It is therefore necessary to support the driven-side pump shaft 9B by bearings in the cover 202 and the pump housing member 203. This leads to a problem when the components are put together in order with the cover 202 at the bottom, for example.

Specifically, if a first subassembly is prepared by force fitting the first bearing bush 68 in the cover 202, a second subassembly is obtained by inserting the pump shaft 9 and the pistons 24 into the pump housing member 203, and the two subassemblies are then joined, the center of the pump shaft 9 cannot easily be aligned with the center of the first bearing bush 68 owing to the uneven weight balance of the eccentric cam 9C and to the fact that the worker cannot see the far end of the pump shaft 9 (the cover-side support section 9D).

Since the cover-side support section 9D of the pump shaft 9 is forced into the first bearing bush 68 after it has been fit into the cover 202, moreover, it is difficult to obtain precise axial alignment.

In the third aspect of the invention, therefore, the first bearing bush 68 is first forced not into the cover 202 but into the pump housing member 203, whereafter the pump shaft 9, washers 60, 61, 62, 63, 64, the roller bearings 65, 67, 66 and the bearing bush 230 are installed in prescribed order, the second bearing bush 69 is pressed lightly onto the housing-side support section 9E of the pump shaft 9, and the pistons 24 are installed to obtain a subassembly.

When this subassembly is joined with the cover 202, the pump shaft 9 can be inserted into the cover 202 as assembled in its final positional relationship with the components associated therewith. As a result, the aforesaid problems are eliminated.

In addition, the portions of the pump shaft 9 supported by bearings (the cover-side support section 9D and the indirect passage 93) can be aligned more precisely when the first bearing bush 68 is inserted first into the pump housing member 203 than when it is inserted first into the cover 202.

For facilitating possible later disassembly of the radial piston pumps for low-viscosity fuel 201, 206, it is preferable for the second bearing bush 69 to be inserted lightly into the pump housing member 203.

As was explained with reference to FIGS. 19 and 20, moderate force-fitting of the second bearing bush 69 into the pump housing member 203 suffices since the second bearing bush 69 is held in place by the retainer 226 and cannot fall out. During disassembly, once the bolts 225 and the retainer 226 have been removed and the second bearing bush 69 been extracted from the pump housing member 203, the pump shaft 9 can also be removed.

Since the illustrated examples are designed on the assumption that the pump housing member 203 will be made of aluminum and the first and second bearing bushes 68, 69 of steel, the bushes are defined as separate members from the pump housing member 203. However, it is possible instead to form the pump housing member 203 and the first and second bearing bushes 68, 69 integrally of a single material.

While the prior-art radial piston pump for low-viscosity fuel comprises separate leaf valve members for the intake and discharge sides, the first aspect of the invention integrates the functions of these two leaf valve members in a single leaf valve member provided with both intake valves and discharge valves and further provides intake side passages and discharge side passages matched to the integrated configuration. As a result, the radial piston pump for low-viscosity fuel can be constituted of as few as two structural bodies, achieves a reduction in the number of its components, is easy to assemble, enables better axial alignment and other improvements in precision, and achieves a reduction in overall size.

In the radial piston pump for low-viscosity fuel according to the second aspect of the invention, the fuel intake, discharge and overflow locations are disposed within the same plane in a single leaf valve member. As a result, the pump can be reduced in overall size, is easy to hook up to external tubing, and ensures reliable cooling and lubrication of the bearing friction points, thereby reducing wear at these points and increasing pump dependability.

Moreover, the assembly method according to the third aspect of the invention increases the efficiency of assembling a radial piston pump for low-viscosity fuel, improves the axial alignment of the pump shaft bearing portions, and ensures that the alignment is maintained even during disassembly.

What is claimed is:

1. A radial piston pump for low-viscosity fuel comprising:

a pump housing formed with intake side fuel passages and discharge side fuel passages, a plurality of pistons disposed radially within the pump housing to be capable of reciprocation, intake valves and discharge valves for enabling intake and discharge of low-viscosity fuel by the reciprocation of the pistons, the pump housing comprising at least two structural bodies, the intake valves and the discharge valves being formed in a single leaf valve member to communicate respectively with the intake side passages and the discharge side passages, and the leaf valve member being disposed between two of the structural bodies of the pump housing.

2. A radial piston pump for low-viscosity fuel according to claim 1, further comprising a pump shaft formed with an eccentric cam for reciprocating the pistons.

3. A radial piston pump for low-viscosity fuel according claim 2, wherein the pump shaft formed with an eccentric cam for reciprocating the pistons is divided into a drive-side pump shaft and a driven-side pump shaft, the pump housing is constituted of a cover and a fixed cylinder which are adapted to accommodate the driven-side pump shaft and a drive-side housing member adapted to accommodate the drive-side pump shaft, and the leaf valve member is disposed between the cover and the fixed cylinder, and further comprising a partition separating the drive-side housing member and the fixed cylinder, and a magnetic coupling having a drive-side magnet attached to the drive-side pump shaft and a driven-side magnet attached to the driven-side pump shaft.

4. A radial piston pump for low-viscosity fuel according to claim 3, wherein only the cover and the fixed cylinder are fastened together with stud bolts and the fixed cylinder and the drive-side housing member are fastened together with housing bolts.

5. A radial piston pump for low-viscosity fuel according to claim 3 wherein, the driven-side pump shaft is rotatably supported by a first bearing bush and a second bearing bush.

6. A radial piston pump for low-viscosity fuel comprising a pump housing formed with intake side pump passages and discharge side passages for low-viscosity fuel, a plurality of pistons disposed within the pump housing to be capable of reciprocation, a pump shaft formed with an eccentric cam for reciprocating the pistons, and a leaf valve member formed in a single plane thereof with overflow ports communicating with the intake side passages, intake valves for opening and closing the intake side passages and discharge valves for opening and closing the discharge side passages, the reciprocation of the pistons causing intake of low-viscosity fuel through the intake side passages and discharge thereof through the discharge side passages.

7. A radial piston pump for low-viscosity fuel according to claim 6, wherein the overflow ports communicating with the intake side passages are further communicated with the intake valves through first communicating passages, the intake valves are communicated with the pistons through second communicating passages, and the pistons are communicated with the discharge side passages through the discharge valves.

8. A radial piston pump for low-viscosity fuel according to claim 6, wherein the intake side passages are communicated with the intake valves and also with the overflow passages, the intake valves are communicated with the pistons by third communicating passages and fourth communicating passages, and the pistons are communicated with the discharge valves by the discharge side passages.

9. A radial piston pump for low-viscosity fuel according to claim 1, wherein the pump housing is constituted of at least a cover and a fixed cylinder having the pistons disposed therein.

10. A radial piston pump for low-viscosity fuel according to claim 9, wherein the pump housing is constituted by fastening together only the cover and the fixed cylinder with stud bolts.

11. A radial piston pump for low-viscosity fuel according to claim 9, wherein an intake passage communicating with the intake side passages, a discharge passage communicating with the discharge side passages and a recirculation passage communicating with the intake side passages for returning fuel to a fuel tank open at an outer surface of the cover.

12. A radial piston pump for low-viscosity fuel according to claim 11, wherein the outer surface of the cover lies in a plane perpendicular to the axis of the pump shaft.

13. A radial piston pump for low-viscosity fuel according to claim 9, wherein a fuel path is established between the opening of the intake passage at the outer surface of the cover and the pistons, by which fuel sucked into the intake passage through the opening at the outer surface of the cover passes through the fixed cylinder via an indirect course taking it along sliding contact surfaces between the eccentric cam and the pistons and through the intake side passages to arrive at the leaf valve member on the side thereof facing the cover and then pass through the leaf valve member to the pistons.

14. A radial piston pump for low-viscosity fuel according to claim 9, wherein a fuel path is established between the pistons and the discharge passage formed in the cover, by which fuel discharged from the pistons passes through the discharge side passages to arrive at the leaf valve member on the side thereof facing the fixed cylinder and then pass into the discharge passage.

15. A radial piston pump for low-viscosity fuel according to claim 1, further comprising cylinder liners formed with intake/discharge passages capable of communicating with the intake side passages and the discharge side passages and the pistons being within and reciprocate in the cylinder liners.

16. A radial piston pump for low-viscosity fuel according to claim 1, wherein the intake valves and the discharge valves are formed in the leaf valve member in pairs spaced at regular angular intervals, the members of each pair being offset from each other in the radial direction of the leaf valve member.

17. A radial piston pump for low-viscosity fuel according to claim 1, wherein the intake valves and the discharge valves are formed in the leaf valve member in pairs spaced at regular angular intervals, the members of each pair being offset from each other in the circumferential direction of the leaf valve member.

18. A radial piston pump for low-viscosity fuel according to claim 1, wherein the intake valves and the discharge valves are formed in the leaf valve member in pairs spaced at regular angular intervals, the members of each pair being offset from each other in the radial direction and the line passing through their centers being inclined at a prescribed angle relative to the radial direction of the leaf valve member.

19. A radial piston pump for low-viscosity fuel according to claim 1, wherein the intake valves and the discharge valves are formed in the leaf valve member in pairs spaced at regular angular intervals, the members of each pair facing in opposite directions.

20. A radial piston pump for low-viscosity fuel according to claim 1, wherein the intake valves and the discharge valves are formed in the leaf valve member in pairs spaced at regular angular intervals, the members of each pair facing in the same direction.

* * * * *